US011073337B2

(12) United States Patent
Huegele et al.

(10) Patent No.: US 11,073,337 B2
(45) Date of Patent: Jul. 27, 2021

(54) AIR-COOLED HEAT EXCHANGE SYSTEM AND METHOD

(71) Applicant: COMPRESSION COMPONENTS TEXAS, LLC, Houston, TX (US)

(72) Inventors: Eric Martin Huegele, Sugar Land, TX (US); Bradley Ray Vick, Waller, TX (US)

(73) Assignee: Compression Components Texas, LLC, Damon, TX (US)

( * ) Notice: Subject to any disclaimer, the term of this patent is extended or adjusted under 35 U.S.C. 154(b) by 37 days.

(21) Appl. No.: 16/750,673

(22) Filed: Jan. 23, 2020

(65) Prior Publication Data

US 2020/0240713 A1 Jul. 30, 2020

Related U.S. Application Data

(60) Provisional application No. 62/796,843, filed on Jan. 25, 2019, provisional application No. 62/796,694, filed on Jan. 25, 2019.

(51) Int. Cl.

| | |
|---|---|
| ***F24H 3/06*** | (2006.01) |
| ***F28D 1/02*** | (2006.01) |
| ***F28D 1/047*** | (2006.01) |

(52) U.S. Cl.

CPC ..... *F28D 1/024* (2013.01); *F28D 1/0477* (2013.01)

(58) Field of Classification Search

CPC ..... F28D 1/024; F28D 1/0477
USPC ..... 165/122
See application file for complete search history.

(56) References Cited

U.S. PATENT DOCUMENTS 5,325,795 A * 7/1994 Nelson ..... B09C 1/06 110/204
2007/0000016 A1* 1/2007 Handa ..... B60K 15/00 2/158

OTHER PUBLICATIONS

Alfa Laval Inc., Complete Cooling Performance Air Cooled Exchangers for the Oil, Gas and Power Markets, Brochure, Jun. 13, 2016, Alfa Laval Inc., Broken Arrow, OK, U.S.A.
AXH Air-Coolers, LLC, AXH air-coolers Type FF, Product Webpage, axh.com, Jun. 23, 2018, AXH air-coolers, LLC, Claremore, OK, U.S.A.
R&R Engineering Co., R&R Engineering Air-Cooled Exchangers 45+ Years Strong, Brochure, Jun. 8, 2016, R&R Engineering Co., Tulsa, OK, U.S.A.

* cited by examiner

*Primary Examiner* — Davis D Hwu
(74) *Attorney, Agent, or Firm* — The Compton Law Firm, P.C.; Scott D. Compton

(57) ABSTRACT

The application is directed to an air-cooled heat exchange system and method. The system may be transported to various locations for on-site operation or, in the alternative, the system may be provided as a permanent installation. The system includes a fluid passageway with two openings interchangeable as a fluid inlet and a fluid outlet of the fluid passageway for fluid to be cooled by the system. The system includes a power source and a blower assembly for generating forced air flow across at least part of the fluid passageway.

9 Claims, 34 Drawing Sheets

AIR-COOLED HEAT EXCHANGE SYSTEM AND METHOD

CROSS-REFERENCE TO RELATED APPLICATIONS

The application is entitled to the benefit of the filing date of the prior-filed U.S. Provisional Patent Application Ser. No. 62/796,694, filed on Jan. 25, 2019, and Ser. No. 62/796,843, filed on Jan. 25, 2019, each of which is herein incorporated by reference in its entirety.

STATEMENT REGARDING FEDERALLY SPONSORED RESEARCH OR DEVELOPMENT

Not applicable.

BACKGROUND OF THE DISCLOSURE

1. Field of the Disclosure

The application is related generally in the field of air cooling of flowable fluid.

2. Background Art

Air cooled heat exchangers are used in oil and gas operations to control or lower the temperature of a fluid flow stream in a fluid line. In basic operation, a heat exchanger is fluidly connected to a fluid line whereby fluid in the fluid line, e.g., fluid flowing through a pipeline, is conveyed through conduit of the heat exchanger whereby fan generated air is blown over the conduit to lower the temperature of the fluid in the conduit prior to discharging the fluid back into the fluid line. Typical heat exchangers in use at the time of this application include a skid mounted vertical fan, a sub-skid or mounting platform, and a separate power source. Typical heat exchangers are relatively large in size, e.g., up to or about 3.7 meters (12.0 feet) in width, 12.2 meters (40.0 feet) in length and 5.5 meters (18.0 feet) in height. Due to size and weight requirements of most highway and interstate systems, the sub-skid and power source must be transported and assembled on location thereby increasing transportation costs and labor costs associated with assembly and disassembly of the individual heat exchanger parts. In addition, current heat exchangers include installation constraints associated with the location and/or directional layout of a particular target fluid line. For example, due to common direction wind conditions in many North American locations, an air intake of a heat exchanger must be oriented in a certain direction for optimum cooling operation of the heat exchanger, e.g., in the state of Texas, U.S.A., an air intake is oriented to receive winds from the south or west as is often the direction of wind in the state of Texas. As such, various fluid lines and/or fluid connections may be required to fluidly communicate the heat exchanger with a target fluid line in order to orient the heat exchanger for optimum cooling operation, further adding to material costs and man hours required for installation and disassembly of the heat exchanger. In other instances, the flow direction of a fluid line may need to be adapted to fit the optimum operating orientation of a particular heat exchanger. Overcoming the above shortcomings is desired.

SUMMARY OF THE DISCLOSURE

The present application is directed to a system for cooling fluid, including a portable platform supporting thereon a fluid flow path assembly, a power assembly including a power source, and a blower assembly in operable communication with the power assembly; wherein the fluid flow path assembly includes a first fluid opening and a second fluid opening interchangeable as a fluid inlet and a fluid outlet of the fluid flow path assembly; wherein at least part of the fluid flow path assembly is located above the blower assembly; and wherein the blower assembly is located between the power source and the first fluid opening and the second fluid opening of the fluid flow path assembly.

The present application is also directed to a system for cooling fluid flowing through a fluid line, including a portable platform supporting thereon a fluid flow path assembly, a power assembly including a power source, and a blower assembly in operable communication with the power assembly; wherein the fluid flow path assembly includes a first fluid opening, a second fluid opening in fluid communication with the first fluid opening and a third fluid opening in fluid communication with the first fluid opening and the second fluid opening, the first fluid opening and the second fluid opening being operationally configured to fluidly connect to a fluid line; wherein the first fluid opening and the second fluid opening are interchangeable as a first fluid inlet of the fluid flow path assembly for receiving fluid from the fluid line at a first temperature and as a first fluid outlet of the fluid flow path assembly for conveying the fluid back into the fluid line at a second temperature; wherein the third fluid opening is operationally configured as a second fluid outlet of the fluid flow path assembly; wherein the blower assembly is located between the power source and the first fluid opening, the second fluid opening and the third fluid opening of the fluid flow path assembly; and wherein at least part of the fluid flow path assembly is located above the blower assembly.

The present application is also directed to a system for cooling pipeline fluid, including a portable platform supporting thereon a blower assembly, a power assembly including a power source and a rotating shaft operationally configured to drive the blower assembly, and a fluid flow path assembly operationally configured to receive fluid from a pipeline at an upstream location of the pipeline and discharge the pipeline fluid back into the pipeline at a downstream location of the pipeline; wherein the fluid flow path assembly includes a first fluid opening and a second fluid opening interchangeable as a fluid inlet and as a fluid outlet of the fluid flow path assembly according to a direction of fluid flowing through the pipeline; wherein the blower assembly is located between the power source and the first fluid opening and the second fluid opening of the fluid flow path assembly; and wherein at least part of the fluid flow path assembly is located above the blower assembly.

DEFINITIONS USED IN THE DISCLOSURE

Figure 1:
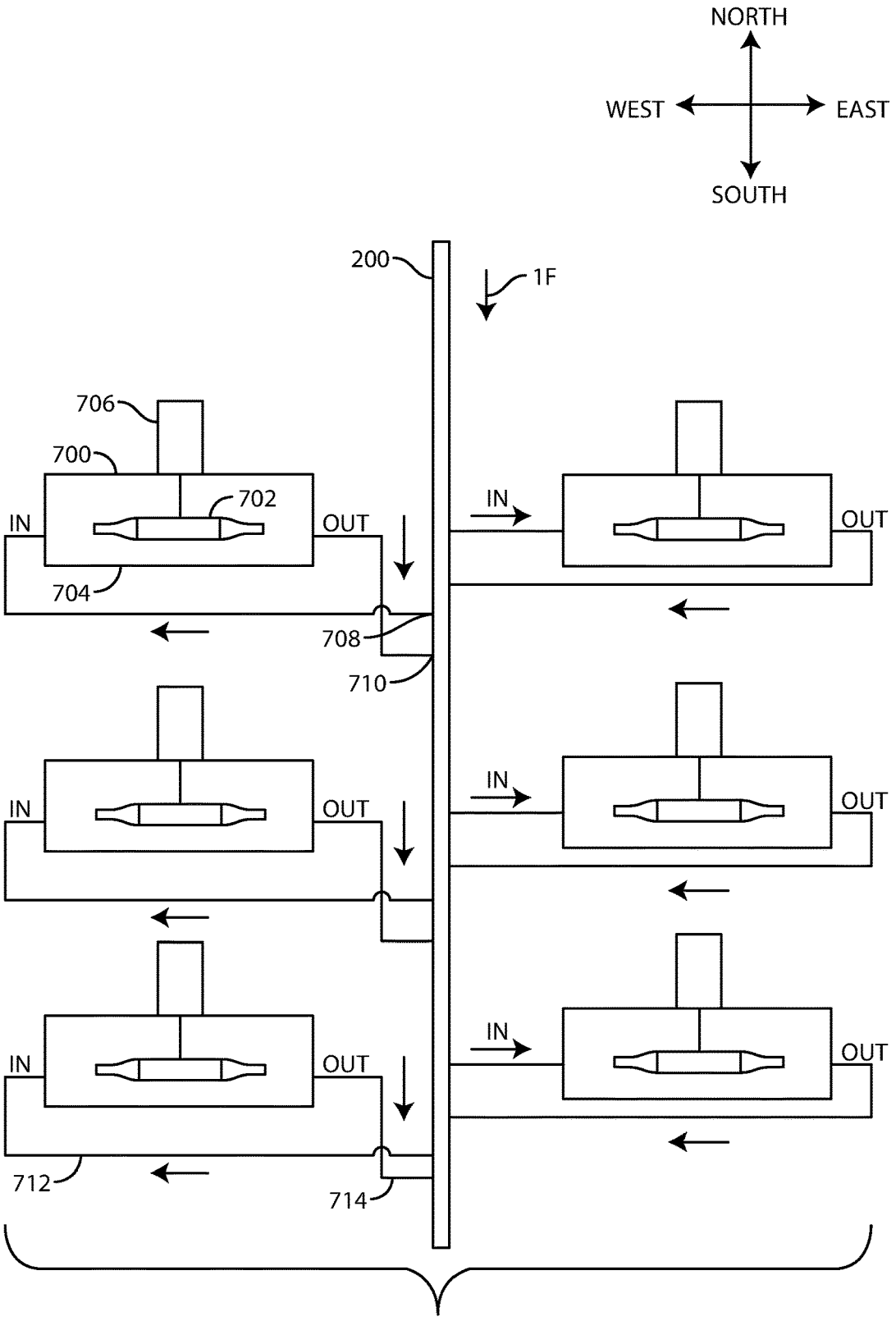
FIG. 1 (Prior Art)
FIG. 1 is a top view illustrating a plurality of prior art air-cooled heat exchangers in use collectively for cooling fluid from a common pipeline at an operation site.

The term "at least one", "one or more", and "one or a plurality" mean one thing or more than one thing with no limit on the exact number; these three terms may be used interchangeably within this application. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

DETAILED DESCRIPTION OF THE DISCLOSURE

For the purposes of promoting an understanding of the principles of the disclosure, reference is now made to the embodiments illustrated in the drawings and particular language will be used to describe the same. It is understood that no limitation of the scope of the claimed subject matter is intended by way of the disclosure. As understood by one skilled in the art to which the present disclosure relates, various changes and modifications of the principles as described and illustrated are herein contemplated.

The present disclosure is not limited to particular embodiments. It is also to be understood that the terminology used herein is for the purpose of describing particular embodiments only, and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. Method steps, processes, and operations described herein are not to be construed as necessarily requiring their performance in the particular order discussed or illustrated, unless specifically identified as an order of performance. It is also to be understood that additional or alternative steps may be employed.

Although the terms "first," "second," "third," and the like may be used herein to describe various elements, components, parts, and/or sections, these elements, components, parts and/or sections should not be limited by these terms. These terms may be only used to distinguish one element, component, part or section from another element, component, part or section. Terms such as "first," "second," and other numerical terms when used herein do not imply a sequence or order unless clearly indicated by the context. Thus, a first element, component, part or section discussed herein could be termed a second element, component, part or section without departing from the teachings of the example embodiments.

Herein, a system of this application may be referred to as an "air-cooled heat exchange system." A system of this application may also be referred to as a "fluid cooling system," a "cooling system," a "fluid treating cooler," a "heat exchanger," and a "fluid treating cooler system." As understood by persons of ordinary skill in the art, "ASTM" refers to the American Society for Testing and Materials or "ASTM International" that develops and publishes technical standards for a wide range of products, systems and services. "ASME" refers to the American Society of Mechanical Engineers. Herein, "kPa" refers to kilopascal and "psi" refers to pounds per square inch or pound-force per square inch. Herein, the abbreviation "MMSCFD" refers to a unit of measurement for gases known as million standard cubic feet per day.

In one embodiment, the present application provides a system and method for the cooling of high temperature fluid flowing through a high-temperature fluid supply line. One type of high-temperature fluid supply line may include a compressed gas and/or fluid conduit including, but not necessarily limited to a pipeline.

In another embodiment, the application provides a system and method for contamination free cooling of high temperature fluid flowing through a high-temperature fluid supply line.

In another embodiment, the application provides an air-cooled heat exchange system of a size and shape whereby two or more individual systems may be set adjacent one another closer in proximity than other heat exchangers currently available as of the date of this application. In one example, the distance between adjacent systems may be less than the width of each individual system.

In another embodiment, the application provides an air-cooled horizontal cooler system for cooling fluid received from one or more fluid sources such as a fluid line prior to discharging cooled fluid from the system back into the fluid line or into one or more different fluid lines and/or storage containers.

In another embodiment, the application provides an air-cooled heat exchange system for a fluid line including a portable platform operationally configured to support thereon (1) a fluid conduit assembly defined by a first opening at a first end of the fluid conduit assembly and a second opening at a second end of the fluid conduit assembly, the first and second openings being fluidly connectable to the fluid line; (2) a fan assembly for generating air flow; and (3) a power source for powering the fan assembly; wherein the fan assembly is disposed between the power source and the first and second openings of the fluid conduit assembly.

In another embodiment, the application provides a fluid cooling system including a portable platform supporting a power source; fluid conduit defined by a first opening at a first end and a second opening at an opposing second end of the fluid conduit; and a plurality of fans in communication with the power source operationally configured to direct air flow onto part of the fluid conduit; wherein the first and second openings are interchangeable as a fluid inlet and fluid outlet for receiving fluid from a fluid line and for discharging fluid into the same fluid line.

In another embodiment, the application provides a portable fluid cooling system for cooling fluid conveyed through a fluid line, the portable fluid cooling system including a portable skid member supporting (a) a fluid conduit assembly for fluidly communicating with the fluid line; (b) a plurality of fans for directing air current across part of the fluid conduit assembly; and (c) a power source for powering the plurality of fans; wherein the fluid conduit assembly includes two fluid openings that may be fluidly connected to a fluid line, the two fluid openings being interchangeable as a fluid inlet of the system for receiving fluid from a fluid line and as a fluid outlet of the system for discharging cooled fluid back into the same fluid line and/or into one or more different fluid lines and/or storage containers.

In another embodiment, the application provides a system for cooling fluid conveyed through a fluid conduit, including (1) a portable skid; (2) a continuous fluid passageway for receiving fluid from a fluid conduit via an upstream port or fluid connection of a fluid conduit and for discharging the received fluid back into the fluid conduit at a downstream port or fluid connection of the fluid conduit; (3) a power source; (4) a fan assembly powered by the power source; wherein the continuous fluid passageway includes a first opening for fluidly connecting to the upstream port or fluid connection and a second opening for fluidly connecting to the downstream port or fluid connection, wherein at least part of the continuous fluid passageway is located between the first opening and the second opening and wherein the fan assembly is disposed between part of the continuous fluid passageway and part of the portable skid. In one embodiment, the continuous fluid passageway may include a horizontally disposed section fluidly connecting the first and second openings, wherein the fan assembly is disposed between the horizontally disposed section of the continuous fluid passageway and part of the portable skid.

In another embodiment, the application provides a system for cooling fluid conveyed through a fluid conduit, the system including a portable skid; a continuous fluid passageway for receiving fluid from the fluid conduit via an upstream port or fluid connection and for discharging cooled fluid back into the fluid conduit via a downstream port or fluid connection; a power source; and a fan assembly powered by the power source; wherein the continuous fluid passageway includes a first fluid opening for fluidly connecting to an upstream port or fluid connection and a second fluid opening for fluidly connecting to a downstream port or fluid connection, and wherein the fan assembly is operationally configured to generate air flow onto at least part of the continuous fluid passageway. In one embodiment, part of the continuous fluid passageway may be disposed between the first fluid opening and the second fluid opening.

In another embodiment, the application provides an air-cooled heat exchange system, including a portable skid supporting (a) a fluid conduit assembly operationally configured to receive therein fluid from one or more external sources and discharge the fluid to one or more external locations; (b) a power source located near a first end of the skid, the power source having an elongated drive shaft extending toward a second end of the skid; (b) a fan assembly including two or more fans in series, each fan being in operable communication with the drive shaft and each fan having a deflector surface for deflecting air generated by the two or more fans onto at least part of the fluid conduit assembly.

In another embodiment, the application provides a portable fluid cooler including (1) an elongated skid member; (2) a power source located near a first end of the skid member; (3) two or more fan assemblies in linear alignment with the skid member lengthwise, each fan assembly of the two or more fan assemblies including a vertical fan and a deflector surface; (4) a fluid passageway defined by a fluid inlet and a fluid outlet, the fluid inlet and fluid outlet being located near a second end of the skid member; wherein at least part of the fluid passageway is located above the two or more fan assemblies.

In another embodiment, the application provides an air-cooled heat exchange system including a portable platform supporting a fluid conduit assembly, a power assembly and a fan assembly; wherein the fluid conduit assembly includes a first opening and a second opening interchangeable as a fluid inlet and as a fluid outlet for receiving fluid from a target fluid source and discharging fluid back into the target fluid source and/or one or more other fluid lines and/or one or more fluid storage containers; wherein the power assembly includes a power source and a drive shaft; and wherein the fan assembly includes a plurality of fans in operable communication with the drive shaft, the fan assembly being operationally configured to direct air flow onto part of the fluid conduit assembly.

In another embodiment, the application provides a fluid cooling system, including a portable platform supporting a fluid passageway assembly, a power assembly and a fan assembly; wherein the fluid passageway assembly includes a first opening and a second opening interchangeable as a fluid inlet and as a fluid outlet of the system for bidirectional fluid flow there through; wherein the power assembly is operationally communicated with the fan assembly; and wherein the fan assembly is operationally configured to direct air flow onto at least part of the fluid passageway assembly.

In another embodiment, the application is directed to an air-cooled heat exchange system, including a portable platform supporting a fluid flow path assembly, a power assembly and a blower assembly; wherein the fluid flow path assembly includes a first opening and a second opening interchangeable as a fluid inlet and as a fluid outlet for receiving fluid from a fluid line at a first fluid temperature and discharging the fluid back into the fluid line at a second fluid temperature; wherein the power assembly includes a power source and a drive shaft; and wherein the blower assembly includes one or more fans in operable communication with the power assembly, the blower assembly being operationally configured to direct air flow onto at least part of the fluid flow path assembly.

In another embodiment, the application is directed to a fluid cooling system including a portable platform supporting a power source, a fluid passageway having a first opening, a second opening and a cooling section fluidly connecting the first and second openings, and a fan assembly for generating forced air flow across the cooling section of the fluid passageway, wherein the first and second openings are interchangeably configured as a fluid inlet and fluid outlet of the system.

In another embodiment, the application is directed to a method of cooling fluid flowing through a fluid line, the method including the steps of (1) providing an air-cooled heat exchange system including a portable platform supporting a fluid flow path assembly, a power assembly and a blower assembly; wherein the fluid flow path assembly includes a first fluid opening and a second fluid opening interchangeable as a fluid inlet and as a fluid outlet for receiving fluid from the fluid line and for discharging fluid back into the fluid line; wherein the power assembly includes a power source and a drive shaft; and wherein the blower assembly includes one or more fans in operable communication with the power assembly, the blower assembly being operationally configured to direct air flow onto at least part of the fluid flow path assembly; (2) fluidly connecting the air-cooled heat exchange system to the fluid line at an upstream location for receiving fluid into the system at a first fluid temperature and fluidly connecting the air-cooled heat exchange system to the fluid line at a downstream location for discharging fluid back into the fluid line at a second temperature lower than the first temperature. In one embodiment, the first fluid opening and the second fluid opening may be located at a first end of the system whereby the system may be fluidly connected to the fluid line by facing the first end of the system toward the fluid line.

Figure 2:
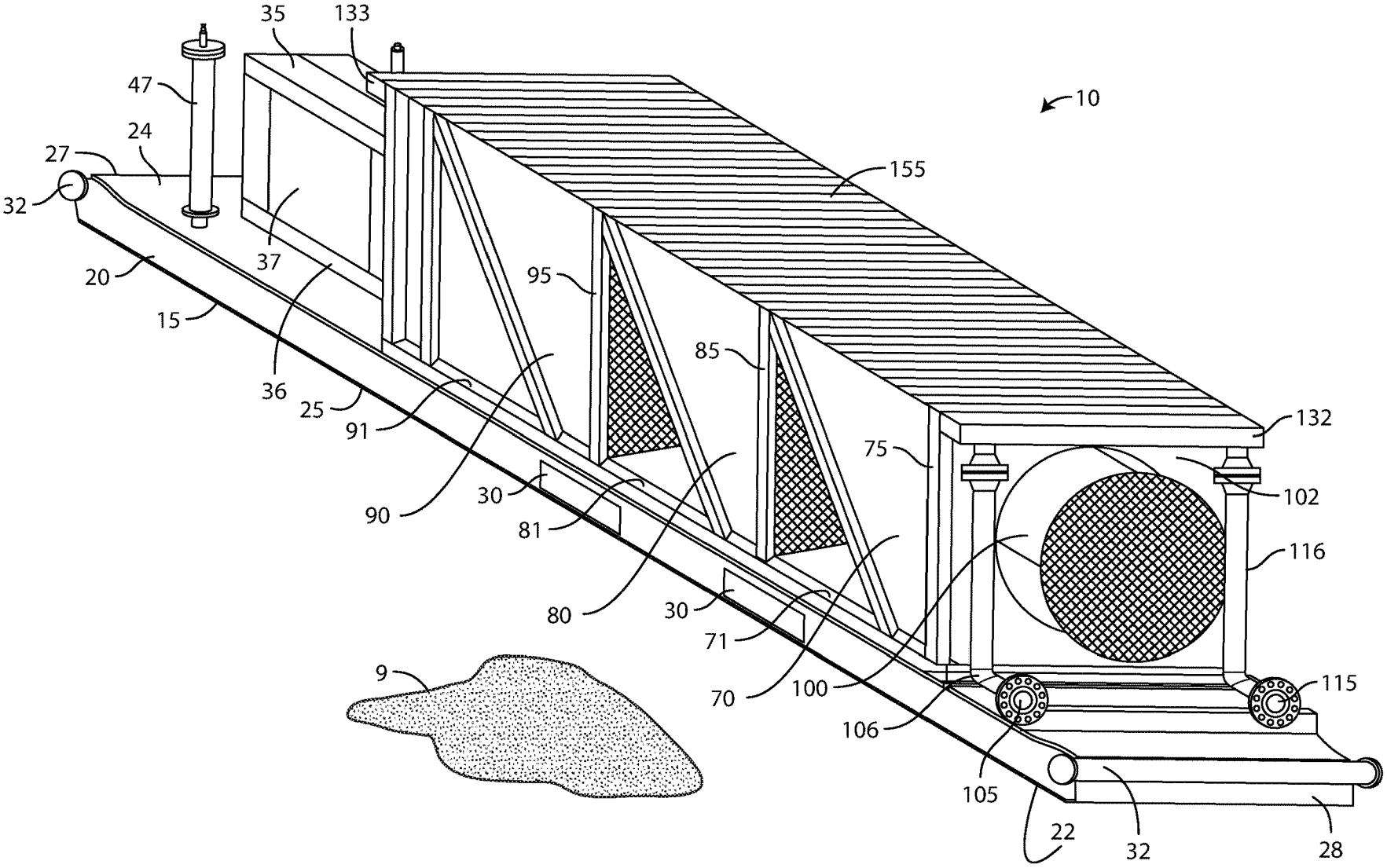
FIG. 2 is a perspective view of an embodiment of a system of this application.
Figure 3:
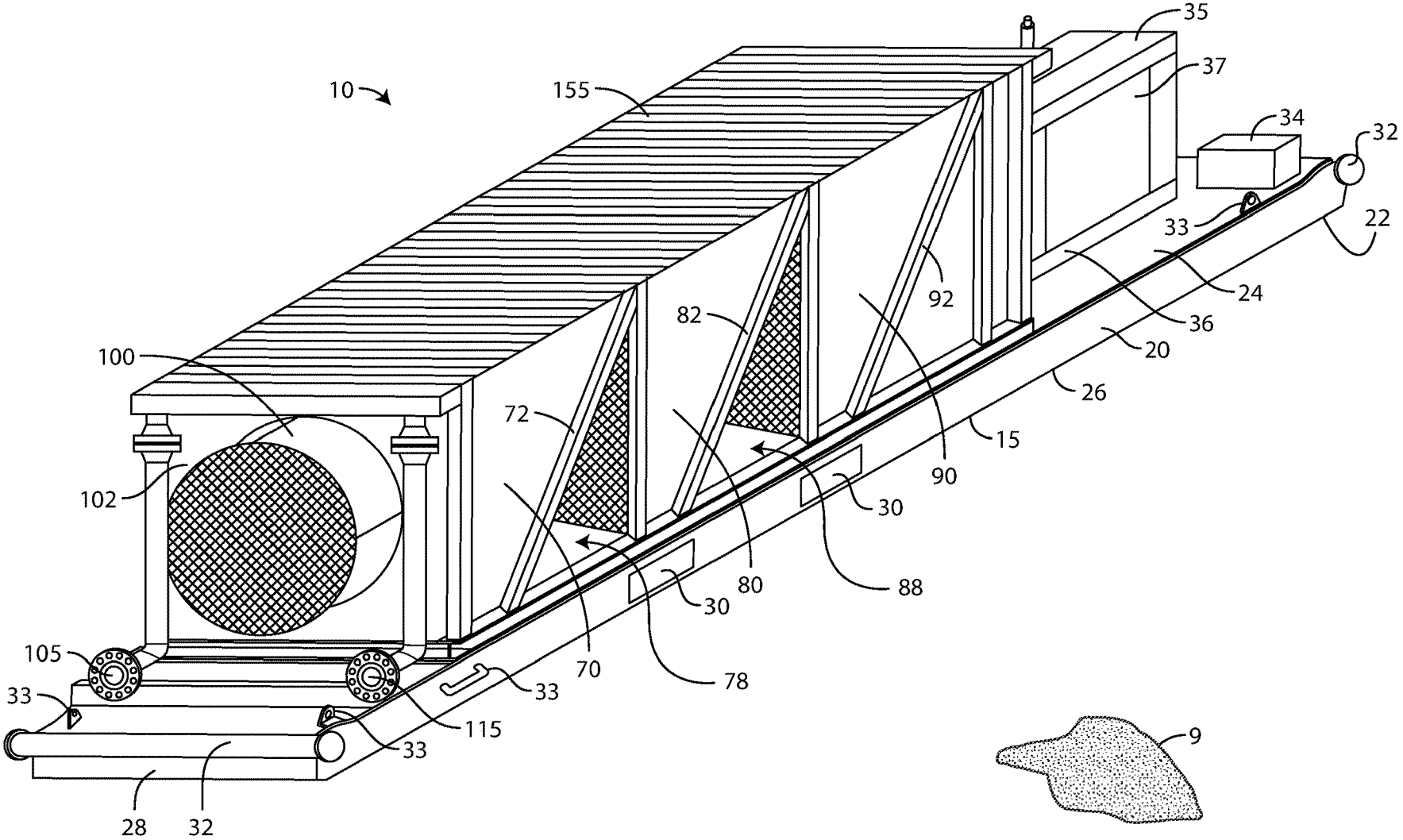
FIG. 3 is another perspective view of the system of FIG. 2.

With reference to FIGS. 2-3, an embodiment of an air-cooled heat exchange system 10 (or "system 10") is provided. In this embodiment, the system 10 includes a main support member 15 (or "platform 15" or "skid member 15") operationally configured to support thereon a power assembly, a blower assembly and a fluid flow path assembly—each of which is discussed below. In this embodiment, the main support member 15 includes a main framework 20 with (1) a first surface member 22 defining a first surface of the main support member 15 for contacting a support surface 9 of the system 10, e.g., the ground, a floor, a hauling platform, or other support surface, and (2) a second surface member 24 (or "surface decking member 24") separated from the first surface member 22, the second surface member 24 defining a second surface of the main support member 15 operationally configured as a deck type surface for supporting components of the system 10 thereon as shown.

In one embodiment, the first surface member 22 may include a planar type surface or a substantially planar type surface disposed across the framework 20. In another embodiment, the first surface member 22 may include a non-planar surface disposed across the framework 20, for example, the first surface member 22 may include one or more raised and/or sunken areas or sections. In one embodiment, the first surface member 22 may be provided as a single member. In another embodiment, the first surface member 22 may include an assembly of two or more individual members or sections.

In one embodiment, the second surface member 24 may include a planar type surface or a substantially planar type surface disposed across the framework 20. In another embodiment, the second surface member 24 may include a non-planar surface disposed across the framework 20, for example, the second surface member 24 may include one or more raised and/or sunken sections. In one embodiment, the second surface member 24 may be provided as a single member. In another embodiment, the second surface member 24 may include an assembly of two or more individual members or sections.

Figure 9:
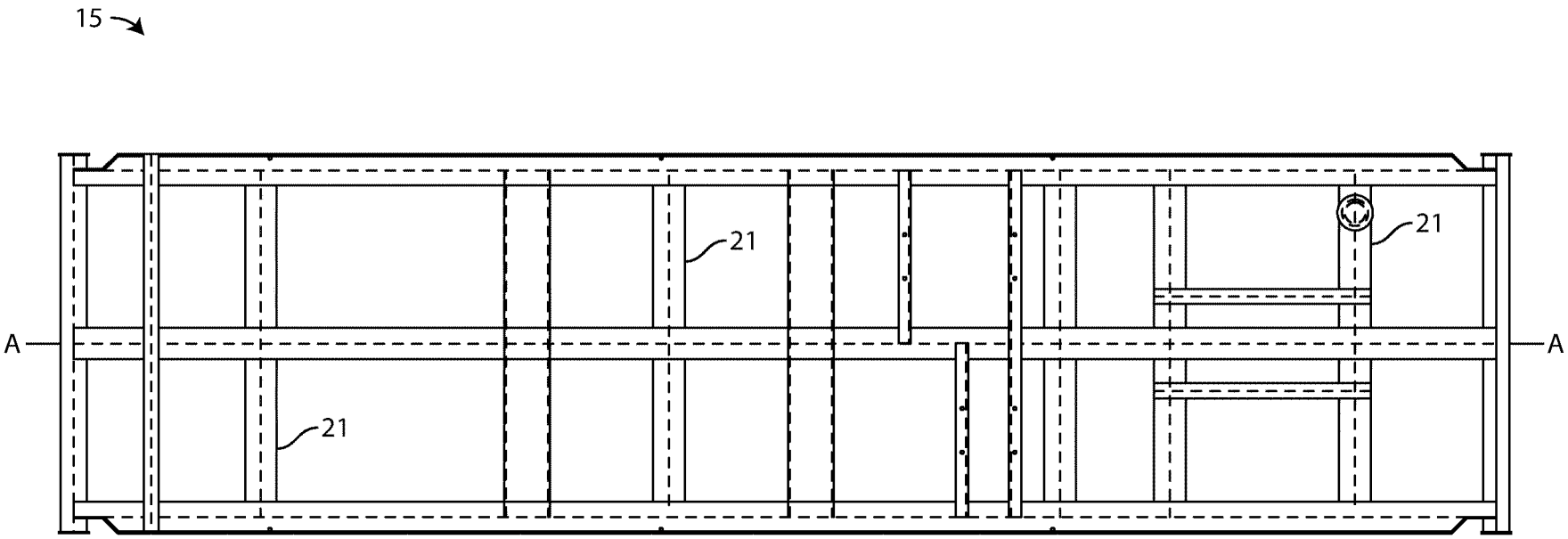
FIG. 9 is a top view of depicting framework of a main support member of the system of FIG. 4.
Figure 10:
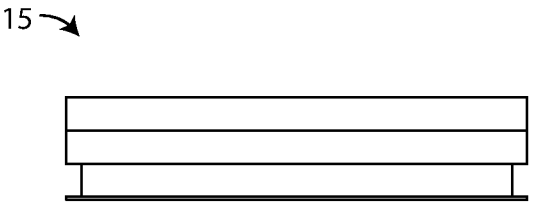
FIG. 10 is an end view of the main support member of FIG. 9.

The framework 20 may include one or more perimeter forming frame members defining the perimeter shape of the main support member 15. The framework 20 may also include one or more additional cross-sectional members 21, e.g., crossbars, for providing added structural support to the main support member 15 (see FIG. 9). Other exemplary cross-sectional members for use herein are provided as described in U.S. Pat. No. 6,763,890, titled "Modular Coiled Tubing System for Drilling and Production Platforms," issued on Jul. 20, 2004, the content of which is herein incorporated by reference in its entirety. As such, the framework 20 may be comprised of a plurality of individual members secured together to form the framework 20. The individual members of the framework 20 and one or more cross-sectional members 21 may be secured together via one or more fasteners, welds, adhesives, and combinations thereof depending on the materials of construction of the framework 20 and the one or more cross-sectional members 21 and/or the intended use of the system 10, anticipated total weight of the system 10, and combinations thereof. Suitable framework 20 fasteners include, but are not necessarily limited to threaded members including threaded screws, nut/bolt type fasteners, rivets, and combinations thereof. Suitable framework 20 members and cross-sectional members 21 for use in oil and gas related operations and other industrial applications may include, but are not necessarily limited to ASTM A992 wide flange beams.

Although the system 10 may be built to scale, in oil and gas related operations and other industrial applications, the main support member 15, including the upper surface of the second surface member 24, may include a height up to or about 35.6 cm (14.0 inches) from a support surface 9 of the system 10. In another embodiment, the upper surface of the second surface member 24 may be set at a height greater than the framework 20 whereby a removable ladder and/or steps or a fixed ladder and/or steps attached to the main support member 15 may be provided for ease of access onto the second surface member 24.

Depending on the intended use of the system 10, the main support member 15 may be constructed from one or more materials effective for system 10 operation. Suitable materials of construction of the main support member 15 may include, but are not necessarily limited to those materials resistant to chipping, cracking, excessive bending and reshaping as a result of ozone, weathering, heat, moisture, other outside mechanical and chemical influences, as well as physical impacts. Exemplary materials of construction include, but are not necessarily limited to metals, plastics, rubbers, fiber reinforced plastic, acrylic glass, filled composite materials, woods, and combinations thereof. In an embodiment of a system 10 operationally configured for oil and gas related operations and other industrial applications, the framework 20 and cross-sectional members 21 may be constructed from one or more metals. Suitable metals include, but are not necessarily limited to stainless steel, mild steel, aluminum, and combinations thereof. Metals such as titanium are contemplated but may not be feasible based on material cost. In one particular embodiment for oil and gas related operations and other industrial applications, the framework 20 and cross-sectional members 21 may be constructed from steel, including, but not necessarily limited to a structural steel alloy commonly referred to as ASTM A992 steel having the following minimum mechanical properties: (1) tensile yield strength, 345.0 MPa (50.0 ksi); (2) tensile ultimate strength, 450.0 MPa (65.0 ksi); (3) strain to rupture (sometimes called elongation) in a 200.0 mm long test specimen, 18.0 percent; (4) strain to rupture in a 50.0 mm long test specimen, 21.0 percent.

In an embodiment of a system 10 operationally configured for oil and gas related operations and other industrial applications, the first surface member 22 and the second surface member 24 may be constructed from like materials or one or more dissimilar materials. For example, the first surface member 22 may be constructed from one or more materials operationally configured to withstand surface frictions and wear and tear as the system 10 is being moved across a support surface 9. Likewise, the second surface member 24 may be constructed of one or more materials comprising a structural strength operationally configured to support system 10 components, heavy equipment and personnel thereon for predetermined and/or extended periods of time. In oil and gas related operations and other industrial applications, suitable materials of construction of the first and second surface members 22, 24 may include one or more types of steel, e.g., low carbon steel commonly referred to as ASTM A36 steel plate by the skilled artisan.

In one embodiment, the main support member 15 may be provided as a one-piece construction. In another embodiment, the main support member 15 may be provided as an assembly wherein the first and/or second surface members 22, 24 may be releasably attached to the framework 20. In one embodiment, the first and second surface members 22, 24 may be attached to the framework 20 via one or more fasteners, welds, adhesives, and combinations thereof depending on the materials of construction of the first and second surface members 22, 24. Suitable fasteners include, but are not necessarily limited to threaded members including threaded screws, nut/bolt type fasteners, rivets, and combinations thereof. In an embodiment of a system 10 operationally configured for oil and gas related operations and other industrial operations, the first and second surface members 22, 24 may be secured to the framework 20 and to the one or more cross-sectional members 21 via welds using a process such as arc welding including, but not necessarily limited to MIG ("metal/inert-gas") welding.

In one embodiment, the first surface member 22 may include one or more additional structural materials or components for purposes of durability, for ease of movement across a support surface 9, for maintaining the system 10 substantially level atop an otherwise unlevel support surface 9, e.g., sloping surfaces, rocky surfaces, uneven surfaces, and combinations thereof. In one exemplary embodiment, a first surface member 22 may include one or more sections of metal, wood and/or plastic and/or rubber and/or composite materials attached thereto as guard type member(s) for the system 10 against wear and tear. Similar material(s) may also be used as risers to elevate the first surface member 22 apart from a support surface 9. It is further contemplated that the system 10 may include one or more jacking legs when the main support member 15 is located on a non-level surface for operation.

The second surface member 24 may include a non-slip surface texture or have an additional non-slip surface member and/or one or more materials added thereto, e.g., non-slip coatings, diamond plate material (steel and/or rubber), rubber decking material(s), diamond tread mats, safety grit non-slip tape, to protect personnel working on the second surface member 24. In another embodiment, the second surface member 24 may include one or more grated sections, e.g., steel grating, allowing small items and fluids, e.g., drops and spills, to be captured by an inner surface of the first surface member 22. As discussed below, the second surface member 24 may include one or more drain members disposed along its surface for capturing liquid spills and the like and for removing captured liquids from the surface of the second surface member 24.

The main support member 15 may also include one or more outer coatings for corrosion protection. The one or more coatings may include any color or combination of colors as desired or as may otherwise be required by rules or regulation. Without limiting the disclosure, in one embodiment a main support member 15 may include a powder coat finish. In one or more embodiments, the main support member 15 may include one or more reflectors, reflective tape and/or lights, e.g., light emitting diodes, and combinations thereof as desired or as may otherwise be required by rules or regulation.

The main support member 15 is not necessarily limited to a particular perimeter shape. For example, the perimeter of the main support member 15 may be provided as a polygon—see the rectangular type shape of the main support member 15 in the embodiment of FIG. 9. The perimeter of the main support member 15 may also be provided as a multi-sided member including one or more curved sides. In another embodiment, the perimeter of the main support member 15 may be provided as a non-sided configuration, e.g., an ellipse such as a circle, oval or the like. In still another embodiment, the perimeter of the main support member 15 may be provided in an irregular shape having irregular shape sides, straight sides, curved sides and angles of any length and size. Regardless the perimeter shape of the main support member 15, one suitable portable system 10 may include a main support member 15 shaped and sized so that the system 10 components are located within the perimeter of the main support member 15 for ease of transport of the system 10 by water, air, or land, e.g., via maritime vessels (ships and watercraft), airplanes, helicopters, flatbed trailers, railcars, or other land vehicles or carriers. As discussed herein, one suitable embodiment of the system 10 operationally configured for oil and gas related operations includes dimensions allowing the system 10 to be transported on vehicular roads and highways in the United States of America and elsewhere without the necessity of obtaining any permits for transportation of the system 10, i.e., the system 10 is suitably provided as a non-permitted load for transportation purposes.

For simplicity of discussion, the main support member 15 will be discussed in terms of having a rectangular type perimeter including first and second sides 25, 26 of an equal length and first and second ends 27, 28 of an equal length for use with known vehicular trailer beds, railcars and other portable hauling type platforms. As understood by the skill artisan, the length of the first and second sides 25, 26 may define the length of the main support member 15 and the system 10, and the length of the first and second ends 27, 28 may define the width of the main support member 15 and the width of the system 10. In another embodiment, one or more components may be secured to the first and/or second side 25, 26 and/or the first and/or second end 27, 28 thereby increasing the length and/or width of the system 10.

Figure 4:
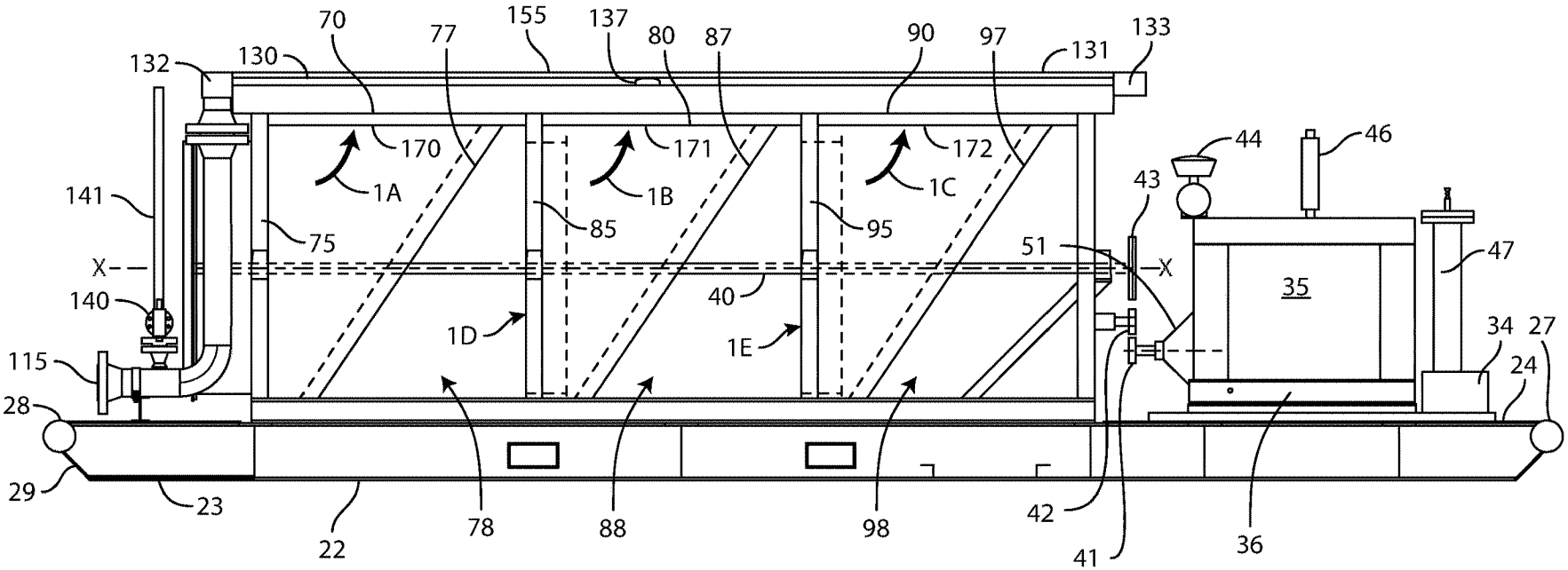
FIG. 4 is a side elevational view of an embodiment of a system of this application operationally configured for cooling compressed gas.

In one embodiment, the main support member 15 may be operationally configured for permanent installation at one or more locations. In another embodiment, the main support member 15 may be provided as a portable member. For example, a portable main support member 15 may include one or more sets of fork pockets 30 and/or one or more drawbars 32 and/or one or more lifting type contact surfaces 33 (see FIG. 3) in the form of one or more lift eyes, handles, hook members, or the like for purposes of moving, lifting and transporting the system 10. As depicted in FIG. 4, the first and/or second ends 27, 28 of the main support member 15 may include a tapered or angled surface 29 to assist with transport of the system 10, for example, when the system 10 is being loaded onto or unloaded off from a truck bed, flatbed trailer or the like. An angled surface 29 configuration of a first end 27 and/or second end 28 may assist to keep the main support member 15 from being buried into natural earth during unloading, which the system 10 may otherwise be susceptible to in conditions where the ground is soft, e.g., in sand, and/or wet or muddy earth. In addition, the angled surface 29 and part of the first surface member 22 extending there from may include one or more second layers of material ("bottom skid plate 23") for purposes of assisting with the loading and unloading of the system 10. In another embodiment, the first and/or second ends 27, 28 of the main support member 15 may include a horizontal surface forming a right angle with the first surface member 22.

As shown in FIGS. 2 and 3, a suitable set of fork lift pockets 30 may be located on one or both sides 25, 26 of the framework 20 allowing forklift access along either side of the system 10. Likewise, a drawbar 32 may be located at one or both ends 27, 28 of the framework 20 providing attachment surfaces for pulling the main support member 15 via a wench line, a tractor or other machine or even manually as necessary. As shown in FIG. 3, lift eyes 33 may be provided on the second surface member 24 near the corners of the main support member 15 for maintaining the system 10 in a substantially level orientation as the system 10 is being lifted and/or transported via a hoist, crane or the like. Likewise, lifting type contact surfaces 33 may also be located on the first and second sides 25, 26 of the framework 20 (see the handle type lifting type contact surface 33 located on the second side 26 in FIG. 3).

In one embodiment, the main support member 15 may also include one or more storage containers 34 located on the second surface member 24 for ease of access (see FIGS. 3 and 4). A storage container 34 may be provided, for example, for storing tools, supplies, food, beverages, fire extinguishers, a first aid kit, system 10 related documents, electronic equipment, and combinations thereof and/or other desired items. In one particular embodiment, the storage container 34 may be utilized as a tool box for storing one or more tools for use on one or more component parts of the system 10 and/or as otherwise desired. As understood by the skilled artisan, the one or more storage containers 34 may include a lockable latch for safekeeping of items stored therein. In addition, the one or more storage containers 34 may include one or more weather seals as known in the art of storage boxes and tool boxes. A suitable storage container 34 may be constructed from one or more materials including, but not necessarily limited to one or more metals, one or more plastics, one or more rubbers, fiberglass, and combinations thereof.

Suitably, the dimensions and/or materials of construction of the main support member 15 may vary according to the type of system 10 provided for one or more particular operations. As such, the main support member 15 may vary in height, length, width, material thickness and total weight. To this end, similar sized main support members 15 may vary in weight. For example, a main support member 15 intended for high stress operations may be constructed of one or more heavy and/or durable materials, e.g., steel, whereby a main support member 15 intended for less stressful operating conditions may be constructed of one or more other materials, e.g., aluminum. As stated above, although the system 10 may be provided in the form of a non-permitted load for roadway transportation purposes, the system 10 is scalable according to one or more operational performance requirements.

With reference to FIG. 4, the system 10 includes a power assembly operationally configured to drive a blower assembly of the system 10. In this embodiment, the power assembly includes at least a (1) power source 35 and (2) a rotating shaft 40 (or "drive shaft 40") operationally communicated with the power source 35. The blower assembly (or "forced air assembly") includes one or more fan members (discussed below) commonly mounted to the rotating shaft 40, wherein the rotation speed of each fan member depends on the rotation speed of the rotating shaft 40 as dictated by the power source 35.

Figure 11:
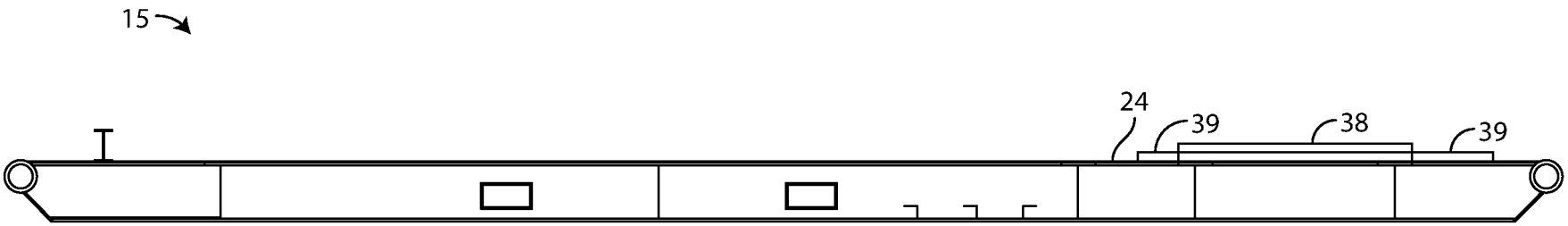
FIG. 11 is a side view of the main support member of FIG. 9.
Figure 12:
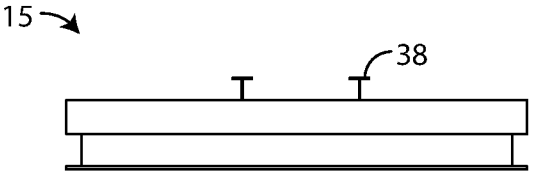
FIG. 12 is an opposing end view of the main support member of FIG. 9.

One suitable power source 35 may include a natural gas engine mounted at or near the first end 27 of the main support member 15, e.g., a natural gas engine including an air filter 44, exhaust 46, and power takeoff 51 ("PTO") as such are known in the art of engines. One exemplary natural gas engine may include, but is not necessarily limited to engine model A54 commercially available from Arrow Engine Company of Tulsa, Okla., U.S.A. As understood by the skilled artisan, a natural gas engines 35 may be fixed to a support frame or pedestal 36 and housed within an enclosure 37 with our without doors. In one embodiment, the engine 35 may be releasably secured to the second surface member 24 alone or releasably secured to both the second surface member 24 and the framework 20 via threaded screws, nut/bolt type fasteners, metal fasteners, and combinations thereof. With reference to FIG. 11, the main support member 15 may include raised members including, but not necessarily limited to elongated mounting supports 38 fixed or releasably attached to the second surface member 24 providing attachment surfaces for a pedestal 36. Suitable mounting supports 38 include, but are not necessarily limited to rectangular beam members, T-shape beam members, I-beam members, and combinations thereof. In one embodiment, a pedestal 36 may be secured to the mounting supports 38 via welds, e.g., welding beads, arc welding including MIG welding.

As also depicted in FIG. 11, the main support member 15 may also include a raised wall 39 or lip type member or "eco-rail 39" or equivalent surrounding the power source 35 in a manner effective to capture any spilled or runoff liquids. In one embodiment, the eco-rail 39 may be provided as a continuous member. As described below, the second surface member 24 may include one or more drains 53 for disposal of liquids located within the boundary of the eco-rail 39. Without limiting the disclosure, in oil and gas related operations one suitable eco-rail 39 may extend up from the surface of the second surface member 24 to or about 6.0 cm (2.4 inches) or a different height as desired. Suitably, the eco-rail 39 includes a height effective to capture fluid therein, but short enough to prevent or minimize accidents to personnel working on the main support member 15, e.g., short enough to prevent or minimize tripping type accidents and ankle twisting injuries to personnel.

As such, the power assembly of the system 10 may also include one or more fuel sources, e.g., one or more fuel storage containers as known to the skilled artisan, providing natural gas for power source 35 operation. In another embodiment, such as in an oilfield type setting where natural gas is readily available via sources such as a fuel gas leader or supply gas provided on-site, the system 10 may be fluidly connected to such sources via a flow line for fueling a power source 35. A suitable flow line in oilfield type settings may include pipe and pipe fittings including, but not necessarily limited to threaded metal pipe and fittings, e.g., 1.0 inch threaded pipe. Herein, other types of power sources 35, e.g., gasoline engines, diesel engines and electric motors, are contemplated for use as desired or as may otherwise be required for one or more particular system 10 operations.

As shown in FIG. 4, the rotating shaft 40 includes an elongated member defined by a longitudinal axis X-X. The rotating shaft 40 extends from a connection point with the power takeoff 51 toward the second end 28 of the main support member 15. Although the alignment of the power source 35 and rotating shaft 40 may vary, in the present embodiment the power source 35 and rotating shaft 40 connected thereto are assembled to the main support member 15 so that the longitudinal axis X-X of the rotating shaft 40 extends lengthwise along the longitudinal center line A-A of the main support member 15 (see FIG. 9). As understood by the skilled artisan, a suitable rotating shaft 40 may include support bearings and couplings constructed from rubber and steel or cast steel. One suitable rotating shaft 40 for use herein is commercially available from Air-X-Hemphill, L.L.C. (d.b.a. AXH Air-Coolers), Tulsa, Okla., U.S.A. As understood by persons of ordinary skill in the art of engine mechanics, the rotating shaft 40 is operably connected to the power source 35 via a series of component parts, such as a series of belts and pulleys, e.g., drive sheave 41, idler sheave 42 and shaft driven sheave 43. As discussed below, the power source 35 rotates the rotating shaft 40, which in turn rotates the one or more fan members of the blower assembly.

Figure 5:
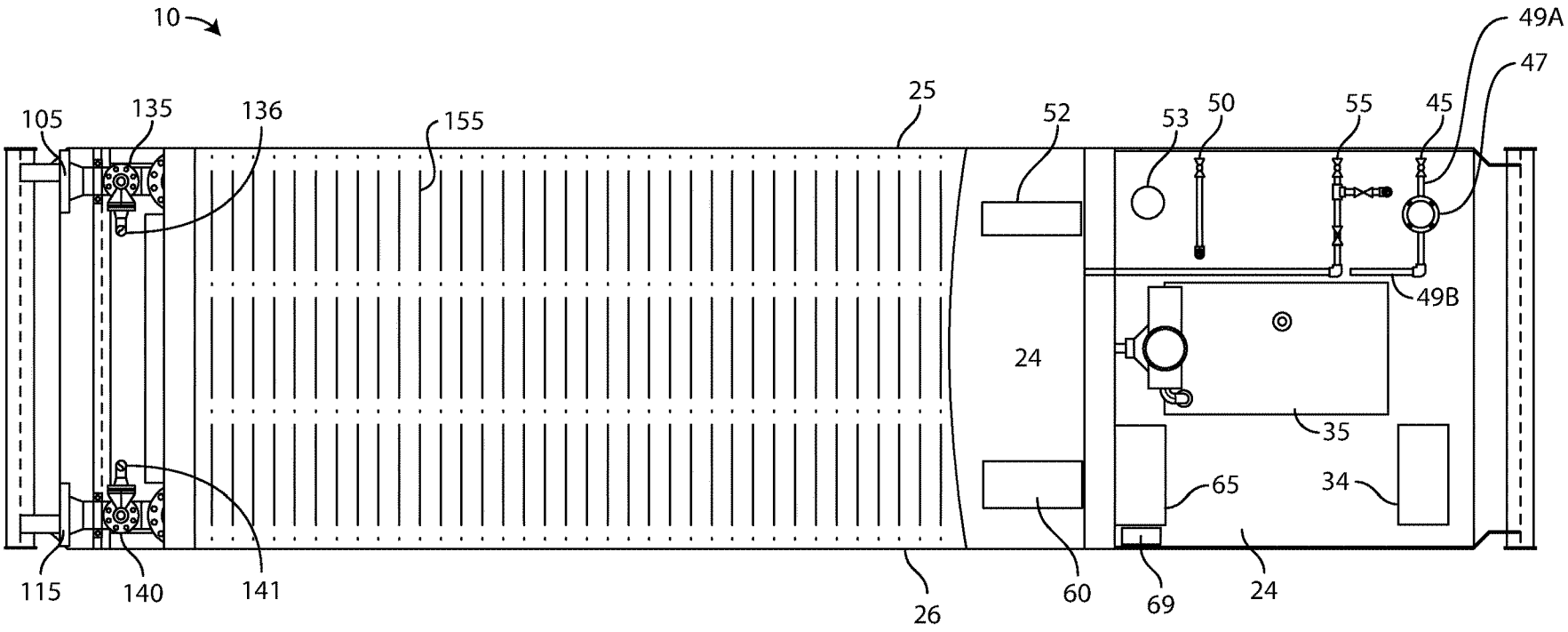
FIG. 5 is a top partial cut away view of the system of FIG. 4.

With reference to FIG. 5, the power assembly of the present system 10 may also include a fuel inlet 45 and a fuel scrubber 47 that is operationally configured to eliminate any unwanted materials from the fuel prior to use by the power source 35. For example, in an embodiment where the power source 35 is a natural gas engine, natural gas received through the fuel inlet 45 is conveyed to a fuel scrubber 47 via fluid line 49A where any unwanted particulates and liquid hydrocarbons may be removed from the natural gas prior to reaching the engine 35 via fluid line 49B. A fuel scrubber 47 may be beneficial for the system 10, at least in part, because the quality of fuel entering the system 10 may vary amongst various operations at one or more locations. One suitable fuel scrubber 47 may be provided as a pressurized vessel equipped with a pressure safety valve ("PSV") for safety purposes, e.g., a PSV rated at 1034.2 kPa (150.0 psi). One suitable natural gas fuel scrubber 47 includes a sock filter commercially available from Western Filter Co., Tulsa, Okla., U.S.A. or PECOFacet (US), Inc., Mineral Wells, Tex., U.S.A.

Still referring to FIG. 5, the power assembly may further include an oil supply inlet 50 for providing lubricant to the power source 35. The power assembly may also include a fluid waste assembly including a fluid container 52 (hereafter "slop tank 52") in fluid communication with one or more drains 53 disposed along the second surface member 24 for storing fluid captured via the one or more drains 53. The slop tank 52 is suitably fluidly communicated with a drain or outlet 55 for discharging fluids captured within the slop tank 52 for removal out from the system 10. In one suitable embodiment, fluids may be directed via gravity into the one or more drains 53 then to the slop tank 52 for storage until the fluid volume within the slop tank 52 reaches a predetermined level whereby a fluid circulation member such as a discharge pump of the system 10 (not shown) may be activated in order to pump fluid out from the slop tank 52. One suitable slop tank 52 may include one or more fluid volume sensors operationally configured to identify the volume of fluid within the slop tank 52, the one or more fluid volume sensors being in electric communication with a fluid circulation member. Suitable fluid volume sensors may include, but are not necessarily limited to float-type switches, hydroelectric switches, pressure sensors/probes, fluid level sensors/probes, and combinations thereof. Suitable discharge pumps include, but are not necessarily limited to positive displacement pumps, e.g., diaphragm pumps, pneumatic pumps. Once a predetermined fluid volume is reached within the slop tank 52, the one or more fluid volume sensors are operationally configured to activate the fluid circulation member to pump fluid out from the slop tank 52.

A suitable slop tank 52 may be constructed from one or more materials including, but not necessarily limited to metals, plastics, composite materials, and combinations thereof. In one embodiment, a suitable slop tank 52, along with corresponding fluid lines connected thereto, may be shaped and sized to be disposed at a point between the first surface member 22 and the second surface member 24. One suitable slop tank 52 operationally configured for oil and gas related operations may include a plastic storage container constructed from polyethylene ("PE"), polyvinyl chloride ("PVC"), polypropylene ("PP), chlorinated polyvinyl chloride ("CPVC"), and combinations thereof. One particular slop tank 52 may include a plastic tank with a pneumatic pump equipped with a float sensor. One exemplary slop tank 52 is commercially available from L&S Supply, Inc., Kingfisher, Okla., U.S.A. In another embodiment, a plurality of slop tanks 52 may be provided as part of a system 10.

The fluid inlet 45, oil supply inlet 50 and outlet 55 may be located along the system 10 as desired. However, for convenience of system 10 operation, the fluid inlet 45, oil supply inlet 50 and outlet 55 may be located in line or in proximity along a common side of the system 10, e.g., a first side 25 of the main support member 15 as shown in FIG. 5. Although the system 10 may be built to scale, in oil and gas related operations the fluid inlet 45, oil supply inlet 50 and outlet 55 may include an inner diameter of or about 2.54 cm (1.0 inch). Each of the fluid inlet 45, oil supply inlet 50 and outlet 55 suitably include connections for receiving separate fluid lines 93 (see FIG. 13) in releasable attachment thereto.

As understood by the skilled artisan, a power source 35 such as a natural gas engine may include an electric starter (not shown) operationally configured to initiate engine operation. As such, the power assembly of the system 10 may include one or more batteries located on the second surface member 24 or stored in a battery box 60 operationally configured to provide power to the electric starter. Similar as the slop tank 52, the battery box 60 may be located between the first surface member 22 and the second surface member 24. In such embodiment, the battery box 60 may be opened via a top lid type member accessible via the second surface member 24. In another embodiment, the battery box 60 may be located atop the second surface member 24. A suitable battery box 60 may be constructed from one or more materials including, but not necessarily limited to one or more metals, one or more plastics, fiberglass, and combinations thereof. Non-limiting examples of suitable metals include, steel, galvanized steel, aluminum, copper, brass, and combinations thereof.

As further shown in FIG. 5, the power assembly may also be provided with control circuitry including a control panel 65 for manual operation of the system 10. One suitable control panel 65 may include buttons, dials, turn knobs, switches, light emitting diode displays, and the like, as known in control panel technology. Another suitable control panel 65 may include a touch screen control panel in addition to or in place of one or more buttons, dials, turn knobs, switches, light emitting diode displays, and the like. In operation, the control panel 65 may be in electric signal communication with the power source 35 to control the rotational speed of the rotating shaft 40. The control panel 65 may also be operationally configured for remote operation allowing one or more system 10 components to be controlled and/or monitored remotely.

In addition, the system 10 may be provided with a full data telemetry system or telemetry package 69 operationally configured to read data of the system 10 via a wireless network, cellular network, satellite network, and combinations thereof. In particular, a suitable telemetry package 69 may be operationally configured to provide (1) remote monitoring of one or more system 10 parameters, (2) system upgrades of the system 10 including software updates that may be performed remotely and (3) data including, but not necessarily limited to tracking of the location, performance and operational status of the system 10. If a user of the system 10 is at a location out of range for remote operation, the telemetry package 69 may be operationally configured to save or store data for retrieval at a later time. The system 10 may also be provided with one or more sensors for monitoring various operating conditions of the system 10. It is further contemplated that the system 10 may be provided with one or more audible alarms and/or one or more visual signals communicated with the control circuitry of the system 10. Without limiting the disclosure, one suitable telemetry package 69 may be provided as a bolt on unit secured to a mountable surface of the main support member 15.

A suitable blower assembly of the system 10 may include one or more blower units operationally configured to direct forced air across at least part of a fluid flow path assembly of the system 10 at a rate effective for reducing the temperature of the fluid conveyed through the fluid flow path assembly an amount of degrees as desired or as otherwise may be required for a particular system 10 operation. As such, the number of blower units employed and the travel distance and/or travel time of the target fluid for cooling may be preset and/or changed in order to meet certain cooling requirements of one or more fluids in one or more system 10 operations. For example, as shown in FIGS. 2-4, one exemplary blower assembly may include three blower units in series and in operable communication with the rotating shaft 40 (see in line blower units 70, 80 and 90 disposed on the second surface member 24). In this embodiment, each blower unit 70, 80, 90 includes a box frame 71, 81, 91 type configuration including (1) a vertically arranged fan member (fan 75, fan 85, fan 95) operationally configured to create forced air flow in a first direction (a horizontal direction), (2) a deflector surface 77, 87, 97 operationally configured to redirect the forced air flow in a second direction, e.g., a vertical direction, for discharge from each of the blower units 70, 80, 90 through openings located at one or more points along an upper portion of each blower unit in a direction opposite the second surface member 24 (see the directional arrows 1A, 1B and 1C representing cooling air being redirected toward the air outlets 170, 171, 172 in FIG. 4), and (3) openings 78, 88 on either side of the blower units 70, 80 at a point below each deflector surface 77, 87 operationally configured to allow ambient air flow into fan 85 and fan 95 of an adjacent blower unit—see directional arrows 1D and 1E, which represent air flow toward fan 85 and fan 95. Ambient air flow into the blower unit 70 is achieved via an opening 100 (also referred to herein as an "open shroud member 100") (see FIGS. 2 and 3) attached to end wall 102 of blower unit 70. In another embodiment, the blower units 70, 80, 90 may include horizontal fans, e.g., horizontal fans driven by electric motors having a common power source or separate power sources. In another embodiment, blower unit 90 may include an opening similar as openings 78 and 88 (see opening 98 in FIG. 4).

Suitable fans 75, 85, 95 may include, but are not necessarily limited to vertically arranged fans with fin members constructed of one or more metals, plastics, composite materials, and combinations thereof. Suitable metals include, but are not necessarily limited to aluminum, copper, steel, galvanized steel, hot-dipped galvanized steel, and combinations thereof. In one particular embodiment, the fans 75, 85, 95 may be constructed from aluminum. In oil and gas related operations, a suitable fan 75, 85, 95 of the system 10 may be rated up to 764.0 rpm or 31.1 horsepower. Likewise, a suitable fan may include a design pressure ranging from 150.0 Pa to 10,000.0 Pa. Commercial sources for a fan 75, 85, 95 may include, but are not necessarily limited to Air-X-Hemphill, L.L.C. (d.b.a. AXH Air-Coolers), Tulsa, Okla., U.S.A.; and R&R Engineering Co., Tulsa, Okla., U.S.A.

Figure 6:
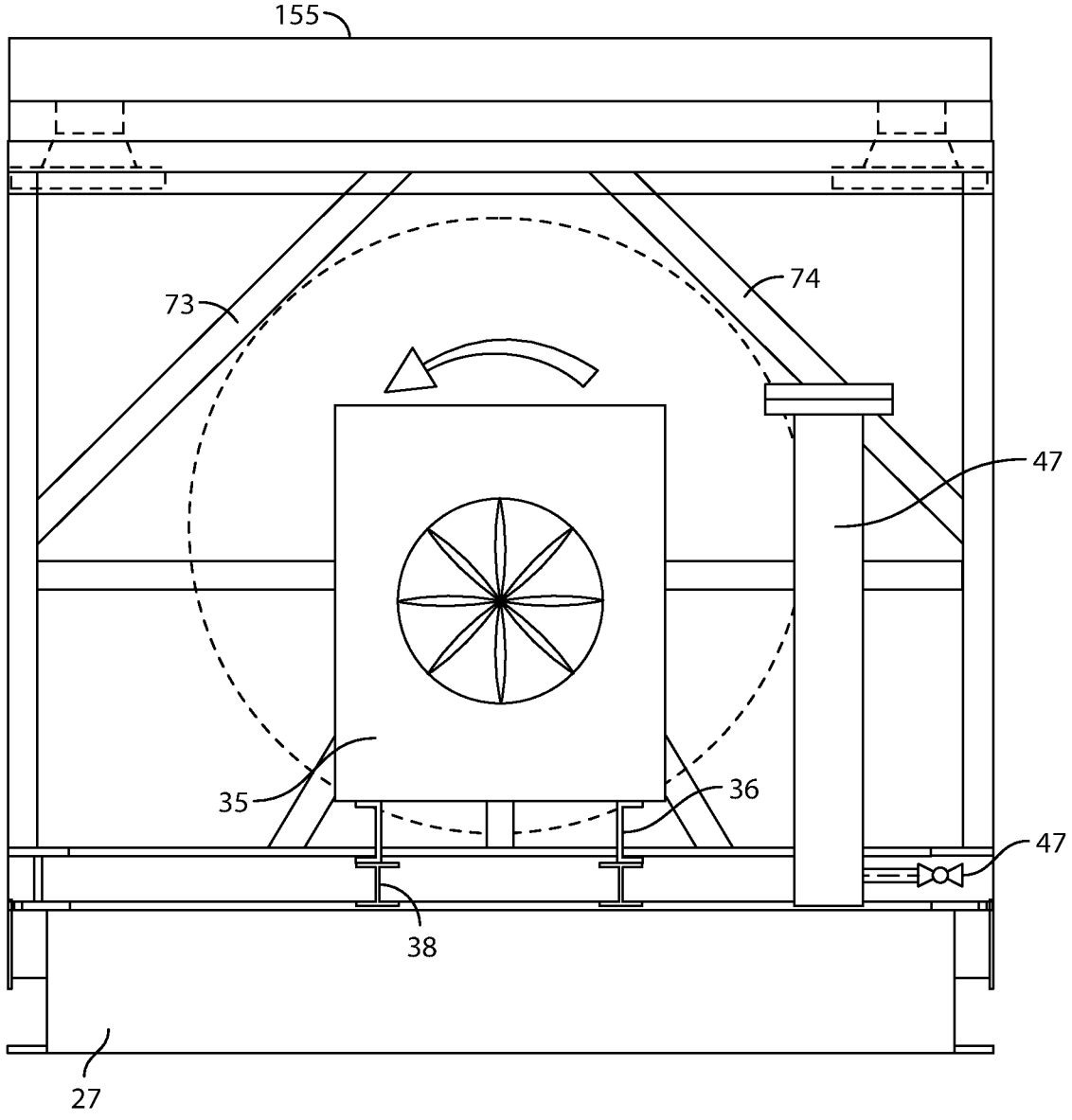
FIG. 6 is an end view of the system of FIG. 4.

The box frame 71, 81, 91 of each blower unit 70, 80, 90 may be comprised of one or more materials suitable for a particular system 10 operation. In addition, one or more of the blower units 70, 80, 90 may include structural support features as desired. For example, see structural support members 72, 82, 92 in FIG. 3, structural support members 73 and 74 in FIG. 6 and the pillow block bearing support members 83 and 84 in FIG. 7. For oil and gas and other industrial applications, the box frames 71, 81, 91 (and various support members discussed in this paragraph) of each blower unit 70, 80, 90 may be constructed of one or more metals including, but not necessarily limited to steel, aluminum, and combinations thereof. In another embodiment, each blower unit 70, 80, 90 may be constructed of cast aluminum. In one embodiment, the blower units 70, 80, 90 may simply be set near one another and/or in abutment with an adjacent blower unit(s). In another embodiment, the blower units 70, 80, 90 may be welded together and/or fastened together via removable fasteners including, but not necessarily limited to nut/bolt type fasteners, threaded screws, clamps, and combinations thereof. In another embodiment, each box frame 71, 81, 91 may be secured to the second surface member 24 via welds and/or one or more fasteners including, but not necessarily limited to nut/bolt type fasteners, threaded screws, and combinations thereof. It is also contemplated that the system 10 may include one or more seals located between adjacent blower units 70, 80, 90 and/or between the blower units 70, 80, 90 and the second surface member 24.

In one embodiment, the openings 78 and 88 of the box frames 71 and 81 may be provided as clear openings exposing the second surface member 24 therein allowing air flow to the fans 85 and 95 as shown in FIGS. 2 and 3. In another embodiment, the box frames 71, 81, 91 may include closed or partially closed sides abutting the second surface member 24. In another embodiment, the openings 78 and 88 may include screens, grills, filters, and combinations thereof effective to allow air flow there through.

A suitable fluid flow path assembly of the system 10 is defined by a fluid passageway operationally configured to receive one or more high temperature flowable fluids into the system 10. In general, high temperature flowable fluids conveyed through the fluid flow path assembly are cooled by the flow of the cooling air discharged from the blower assembly. Suitable high temperature flowable fluids may include gases and/or liquids originating from external sources such as a high temperature fluid line and/or high temperature fluid storage container. Examples of fluid(s) that may be cooled via the system 10 include compressed gases and/or pressurized fluids such as pressurized liquids.

Figure 7:
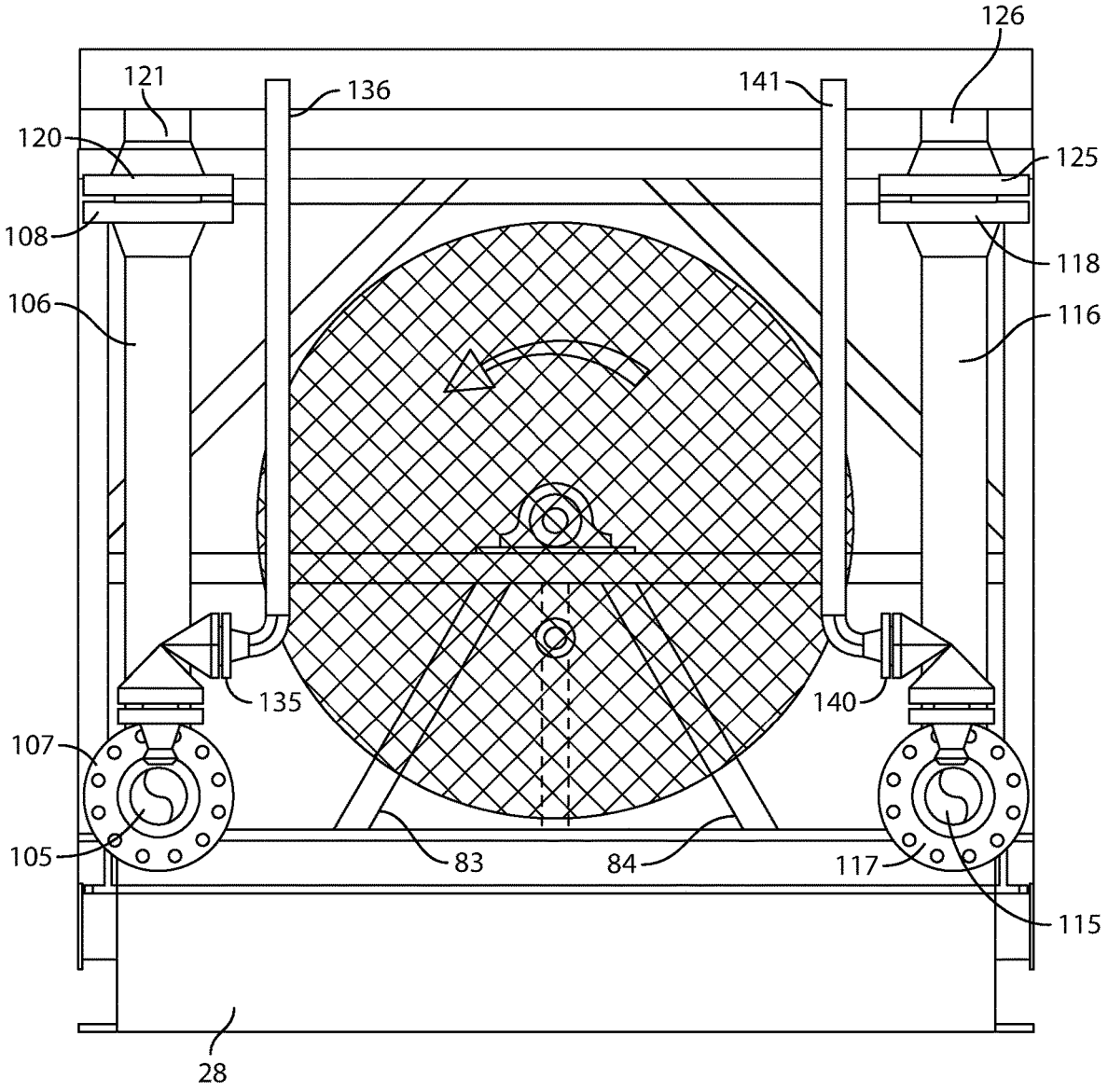
FIG. 7 is opposing end view of the system of FIG. 4.

One simplified embodiment of the system 10 operationally configured for cooling compressed natural gas is depicted in FIG. 7. In this embodiment, the fluid flow path assembly includes two fluid openings, namely, a first fluid opening 105 and a second fluid opening 115—each of the fluid openings 105, 115 being operationally configured for use as a fluid inlet or as a fluid outlet of the fluid flow path assembly of the system 10 according to a desired direction of fluid flow through the fluid flow path assembly. In other words, the first fluid opening 105 and the second fluid opening 115 are interchangeable as a fluid inlet and a fluid outlet of the fluid flow path assembly of the system 10. In one embodiment, the fluid openings 105 and 115 may define the open ends of a single continuous fluid flow path. In one embodiment, a fluid flow path may include a single conduit member. In terms of a system 10 as shown in FIGS. 2-7, the fluid flow path assembly may comprise a plurality of fluidly sealed fluid conduits oriented in a manner effective to provide a directional fluid passageway that is operationally configured for passing air flow to cool the fluid flowing therein a desired amount of degrees prior to discharge of the fluid from the system 10. For example, as shown in FIG. 7 the fluid openings 105 and 115 define openings for separate conduit sections 106 and 116 (or "non-cooling sections") that are fluidly connected to a horizontally oriented cooling section of the fluid flow path assembly.

Still referring to FIG. 7, the fluid openings 105 and 115 may be located at or near the second end 28 of the main support member 15 facing out from the system 10 in a parallel orientation for ease of connection with tubulars and other fluid conduits for receiving and discharging fluid in and out of the system 10. The conduit sections 106 and 116 are provided as nonlinear L-shape type members (see FIG. 4) each having a horizontal section for positioning fluid openings 105 and 115 as shown in FIG. 7 and a vertical section providing fluid openings at the opposing end of sections 106 and 116 for fluidly connecting to a cooling section of the fluid flow path assembly. In this embodiment, each of the fluid openings 105 and 115 includes a flange member as is common in making fluid conduit connections, e.g., see flange members 107 and 117 of fluid openings 105 and 115, which provide mating surfaces for flange members of separate tubulars or other fluid conduits to be fluidly communicated with the fluid openings 105 and 115, e.g., fluid conduits for fluid pipeline outlets and inlets. In another embodiment, e.g., low pressure system 10 type operations, it is contemplated that the fluid flow path assembly may include flangeless fluid conduits connected via mechanical sleeves, elbows, clamps, couplings, fittings, barbs, nipples, reducers, and the like, as known in the art of fluid conduits. Although the system 10 may be built to scale, in oil and gas related operations the fluid openings 105 and 115 may include inner diameters of or about 15.24 cm (6.0 inches).

As depicted in FIG. 7, the upper open ends of the vertical sections 106 and 116 may include flange members 108 and 118 for mating with flanged openings 120 and 125 of elbow members 121 and 126 that fluidly interconnect the non-cooling sections 106 and 116 with the cooling section of the fluid flow path assembly. Looking at FIG. 4, one suitable cooling section 130 may be disposed above the blower assembly in a compartment 131 defined by opposing header members 132 and 133 that are operationally configured to hold the cooling section 130 in a fixed position. In another embodiment, a cooling section 130 may be provided with at least part of the cooling section 130 being exposed and not housed within a compartment 131. In one embodiment, a major part of the fluid flow path assembly may be located above the blower assembly. Herein, a "major part" means greater than 50.0% of the fluid flow path assembly.

One or more cooling section support members 137 may be located within the compartment 131 at one or more desired points operationally configured to maintain the cooling section 130 in a linear or substantially linear alignment (or "horizontal alignment or "substantially horizontal alignment" as shown in FIG. 4) between the opposing header members 132 and 133. The one or more cooling section support members 137 may be constructed from one or more metals, one or more plastics, one or more rubbers, and combinations thereof. Herein, the assembly of the compartment 131, the cooling section 130, the opposing header members 132, 133 and the cooling section support members 137 (collectively referred to herein as a "cooling bundle") may be secured together for operation as shown in FIG. 4 via welds, nut/bolt type fasteners, threaded screws, clamps, and combinations thereof.

Figure 13:
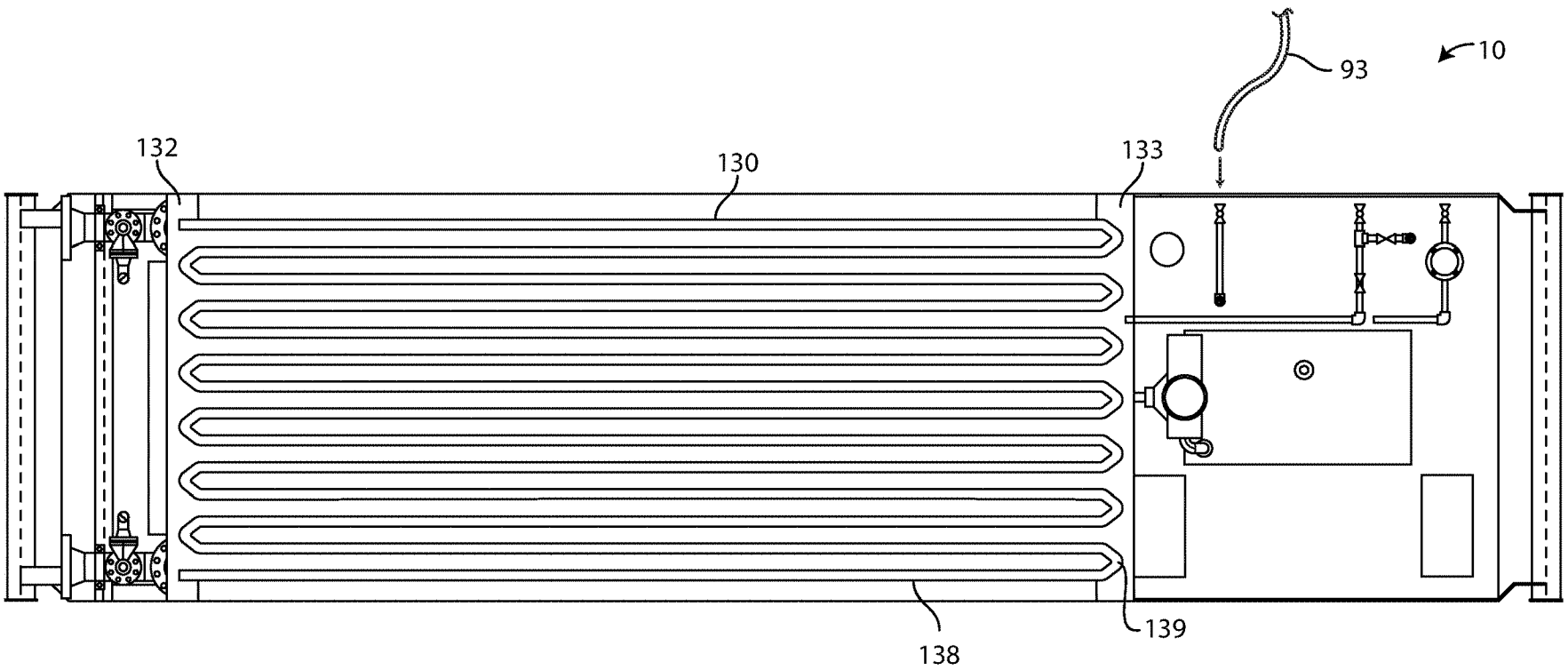
FIG. 13 is a top partial phantom view depicting a cooling section of a fluid flow path assembly of an embodiment of a system of this application.

Without limiting the disclosure, a suitable cooling section 130 may be configured or include a layout or pattern effective to provide a desired duration that fluid is exposed to cooling within the cooling section 130 via the forced air created by the blower assembly. In other words, the cooling section 130 suitably includes a fluid flow path of a length effective to cool fluid flowing through the cooling section 130 an amount of degrees as desired or as otherwise may be required for a particular system 10 operation. In one suitable embodiment, the cooling section 130 may include a serpentine flow path as illustrated in FIG. 13 including a plurality of elongated sections 138 and bend sections 139 interconnecting the elongated sections, wherein a first end of the cooling section 130 is fluidly mated with elbow member 121 and a second end of the cooling section 130 is fluidly mated with elbow member 126. For purposes of the present system 10, a serpentine cooling section 130 (or "heat exchange conduit section") may be operationally configured to facilitate the sealed flow of fluid in order to maximize the travel distance and/or duration of the fluid flow there through allowing blower assembly forced air flow to act upon the fluid in the cooling section 130 in a manner effective to lower the temperature of the fluid from an initial temperature entering the system 10 to a final temperature at discharge from the system 10.

A serpentine pattern is not limited to any particular form, but is suitably configured to establish the distance of fluid flow as desired for one or more cooling operations requiring a fluid temperature drop of a desired amount of degrees. In oil and gas related operations and other industrial applications, the non-cooling sections 106 and 116 and the cooling section 130 may employ conduit having an inner diameter ranging from or about 5.08 cm (2.0 inches) up to or about 40.6 cm (16.0 inches). The outer diameter of the conduit of the cooling section 130 may also vary as desired or as otherwise required for a particular system 10 operation as the smaller the outer diameter of the conduit used the more elongated sections 138 of conduit that may be provided in a particular compartment 131. In addition, the elongated sections 138 of a serpentine cooling section 130 may be spaced apart as desired, which may also determine the total number of elongated sections of the cooling section 130. Although the system 10 may be built to scale, in one embodiment as shown in FIG. 4 the length of a serpentine cooling section 130, start to end, may be up to or about 76.2 meters (250.0 feet). In operations for cooling compressed gases, the travel time of compressed gas through a serpentine cooling section 130 as shown in FIG. 13, start to end, may range from about 500.0 seconds to about 3000.0 seconds. Other periods of time may be realized as desired.

Figure 14:
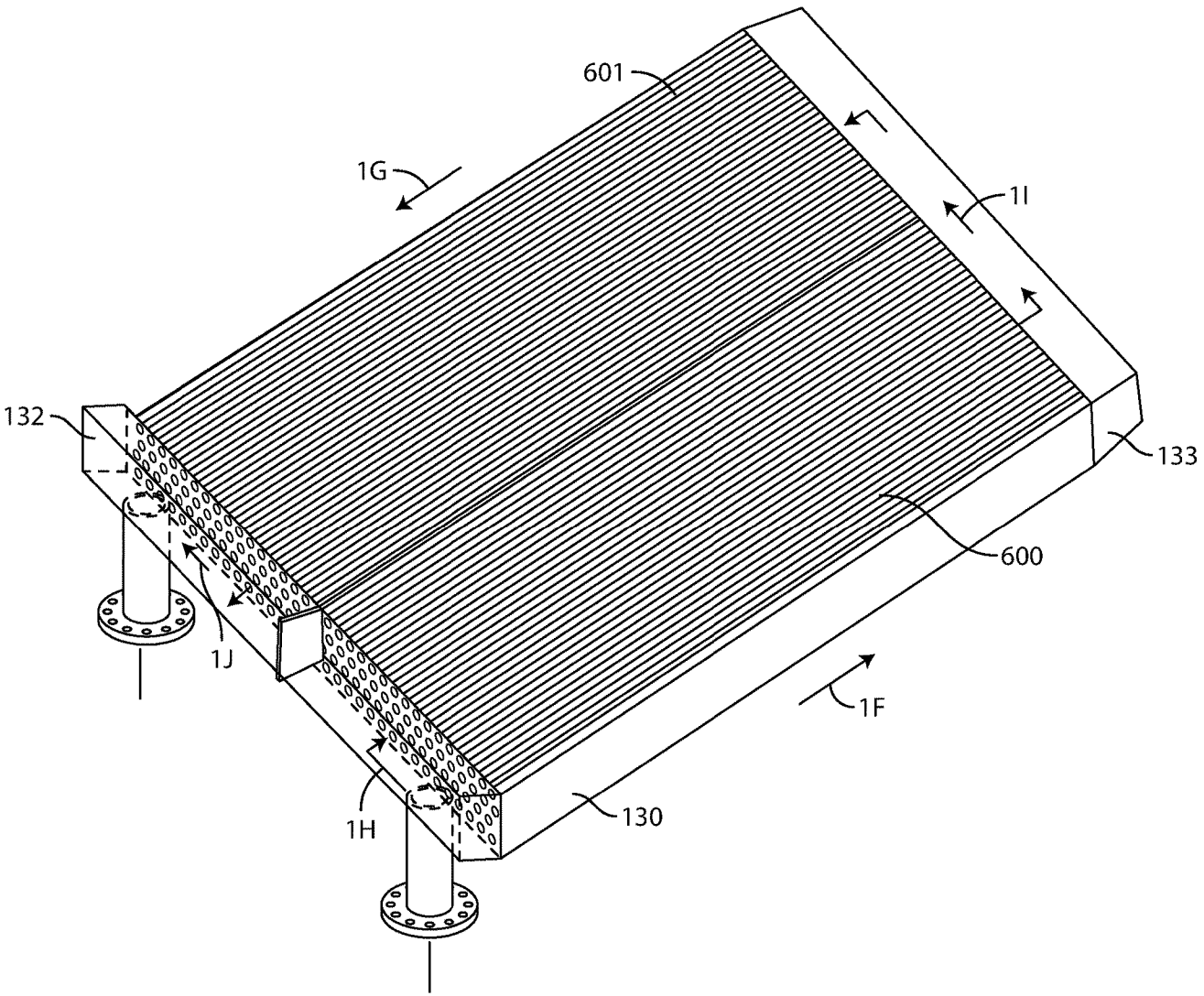
FIG. 14 is a perspective view of another embodiment of a cooling section of a system of this application including a phantom view of a header member.
Figure 15:
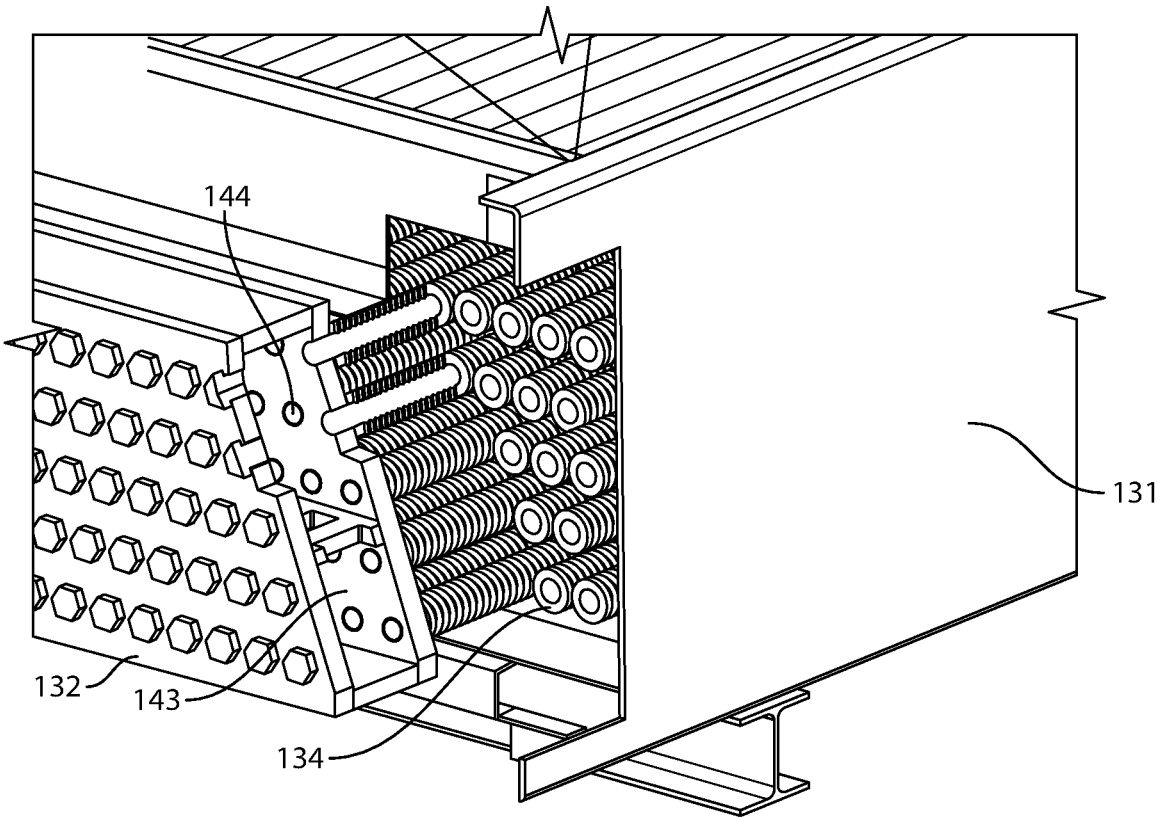
FIG. 15 is a perspective cut out view of a header member and corresponding cooling section of an embodiment of a system of this application.

Referring now to FIGS. 14-15, in another embodiment a cooling section 130 may include two or more sets or groupings of a plurality of elongated tubular members 134 or "tubular bundles" or "coil bundles" also referred to herein as "tubular member set 600" and "tubular member set 601" providing directional fluid flow between header members 132, 133—see Directional Arrows 1F and 1G illustrating exemplary directional flow of fluid through tubular member sets 600 and 601. Also see Directional Arrows 1H, 1I, 1J, which illustrate fluid flow through the header members 132, 133. In the illustration of FIG. 14, fluid is transferred from a first part of header member 132 to header member 133 along about one half the cooling section 130 via tubular member set 600. Likewise, fluid is transferred from header member 133 to a second part of header member 132 along the opposite half of the cooling section 130 via tubular member set 601. In another embodiment, fluid may flow in an opposite direction as shown in FIG. 14.

With reference to FIG. 15, each header member 132, 133 includes a compartment or housing for fluid flow there through including an inner wall 143 defining a physical barrier between the header members 132, 133 and the compartment 131 housing the cooling section 130. In this embodiment, the inner wall 143 includes a plurality of apertures 144 there through, each aperture 144 corresponding to a particular elongated tubular member 134 for receiving fluid into a header member 132, 133 or conveying fluid from a header member 132, 133 into the elongated tubular members 134 (see Directional Arrow 1I in FIG. 14). In one embodiment, opposing ends of each elongated tubular member 134 may be fluidly communicated with a particular aperture 144 of an inner wall 143 of each of the header members 132, 133. In one non-limiting embodiment, the opposing ends of each elongated tubular member 134 may be fluidly communicated with apertures 144 via welds. In another non-limiting embodiment, the opposing ends of each elongated tubular member 134 and corresponding apertures 144 may include machined connections. Machined connections may further include one or more high temperature, high pressure sealants. As described above, one or more cooling section support members 137 may also be employed as desired or as otherwise required for maintaining the elongated tubular members 134 in a linear or substantially linear alignment.

Figure 8:
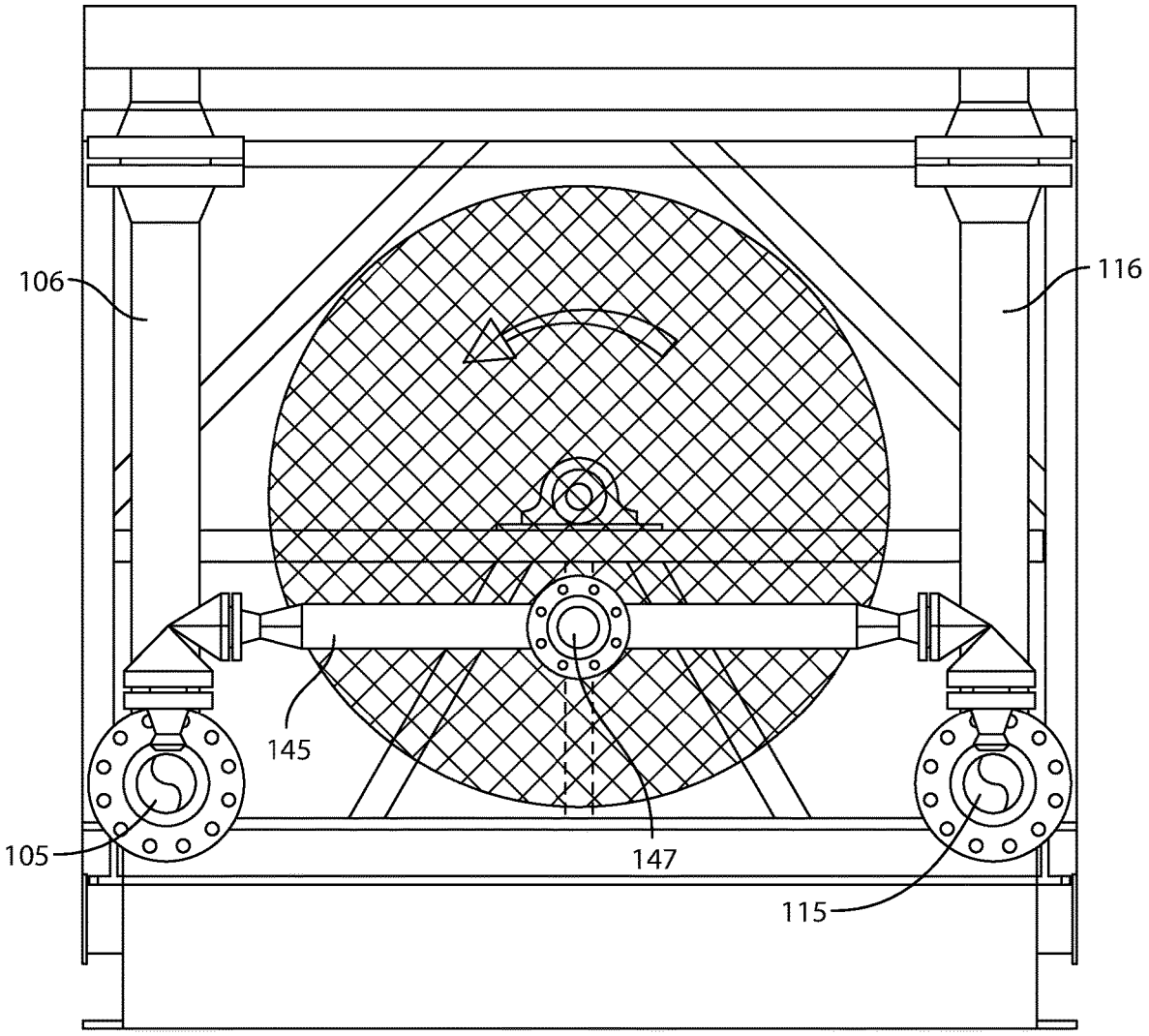
FIG. 8 is an end view of another embodiment of the system for cooling compressed gas and pressurized fluid.
Figure 16:
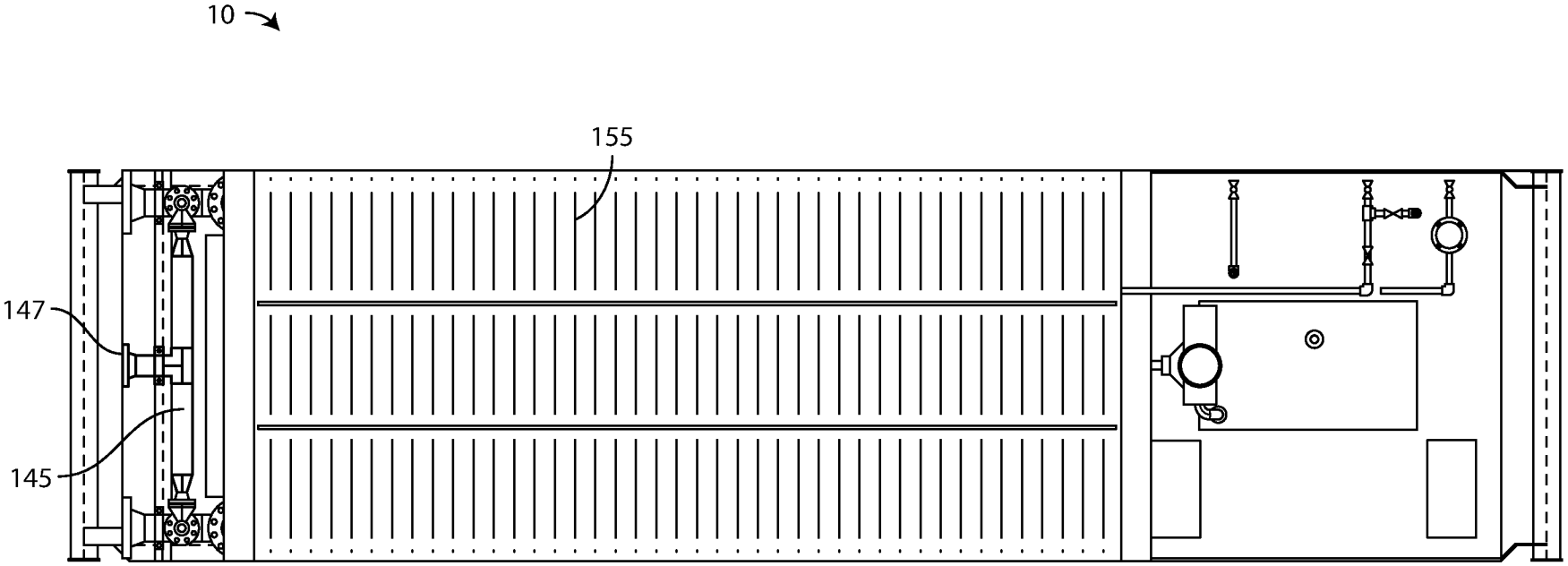
FIG. 16 is a top view of an embodiment of a system of this application operationally configured for cooling compressed gas and pressurized fluid.
Figure 17:
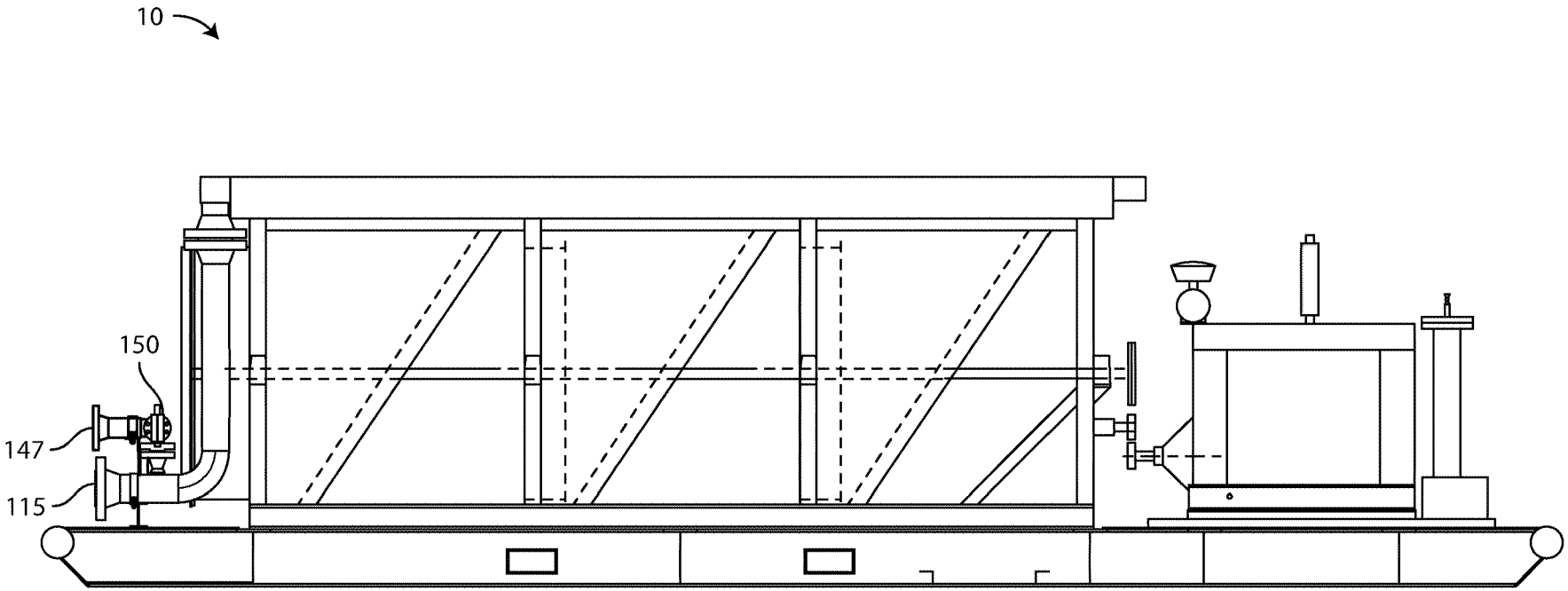
FIG. 17 is a side elevational view of an embodiment of a system of this application operationally configured for cooling compressed gas and pressurized fluid.

The number and size of elongated tubular members 134 may vary as desired according to one or more particular cooling operations of the system 10. In an embodiment of the system 10 operationally configured for oil and gas related operations and other industrial applications, a cooling section 130 may include from two hundred to three hundred elongated tubular members 134, each elongated tubular member 134 having an inner diameter ranging from 1.0 cm to 2.0 cm (0.394 inches to 0.787 inches). In one particular embodiment of the system 10 operationally configured for oil and gas related operations, the cooling section 130 may include a total of two hundred fifty (250) to two hundred sixty (260) elongated tubular members 134, each elongated tubular member 134 having an inner diameter of or about 1.59 cm (0.625 inches). In operations for cooling compressed gases, the travel time of fluid flowing through the cooling section 130 of FIG. 14 may vary according to one or more conditions, such as the total volume of the fluid flow path assembly, the temperature of compressed gas, the pressure conditions of the cooling section 130, and combinations thereof. In one exemplary embodiment of the system 10 as shown in FIGS. 8, 16 and 17 including a cooling section 130 as shown in FIG. 14, the travel time of fluid such as compressed gases flowing through the cooling section 130 may range from about 500.0 seconds to about 3000.0 seconds.

The cooling section 130 may be constructed from one or more materials according to the anticipated fluid temperature(s) and/or pressures of the system 10 and/or chemical nature of fluids to be cooled therein. For example, certain materials have better anti-corrosive properties than other materials. For oil and gas related operations and other industrial applications, suitable cooling section 130 materials of construction may include one or more metals effective for use at temperatures up to 176.7° C. (350.0° F.). Suitable cooling section 130 metals may include, but are not necessarily limited to stainless steel, mild steel, aluminum, and combinations thereof. Metals such as titanium are contemplated but may not be feasible based on material cost. In one embodiment, the non-cooling sections 106 and 116 (see FIG. 7) and the elongated tubular members 134 of the cooling section 130 may be constructed from seamless carbon steel nominal wall pipe for high-temperature services such as ASTM A106 Seamless Pressure Pipe (or ASME SA106 pipe) as such terms are known in the art of pipe specifications.

Referring to FIGS. 4, 5 and 7, in an embodiment of the system 10 for cooling compressed gas, the fluid flow path assembly may include relief piping including (1) relief valves 135 and 140 and (2) vent members 136 and 141 (shown here as open ended tubular members) fluidly communicated with the non-linear sections 106 and 116, the relief piping being operationally configured to protect the system 10 from over pressure by venting of gas to the atmosphere. The vent members 136 and 141 may be provided at varying lengths and/or inner/outer diameters and/or shapes as desired. In one embodiment, each of the vent members 136, 141 may include vertically oriented open ended steel pipe fluidly communicated with relief valves 135 and 140 as shown in FIG. 7.

Suitable relief valves 135 and 140 may include, but are not necessarily limited to pressure safety valves ("PSV") and/or pressure relief valves ("PRV") fluidly connected to the non-linear sections 106, 116 via flanged connections as known to persons of ordinary skill in the art of valve connections. Under typical operating conditions, each PSV is vented to atmosphere via the vent members 136 and 141. As understood by the skilled artisan, venting occurs when the fluid pressure exceeds a preset PSV pressure set point of the system 10. In oil and gas related operations and other industrial applications, one suitable PSV pressure set point, i.e., maximum allowable working pressure, for an embodiment of the present system 10 for cooling compressed gas may include a PSV pressure set point of or about 9928.5 kPa (1440.0 psi). As understood by the skilled artisan, the maximum allowable working pressure may be changed as desired. For example, in oil and gas related operations for cooling compressed gas it is herein contemplated that the PSV pressure set point or maximum allowable working pressure may range from 1034.2 kPa to 41368.5 kPa (150.0 psi to 6000.0 psi).

Referring to FIGS. 8, 16 and 17, in an embodiment of the system 10 operationally configured for cooling compressed gas and pressurized fluids, i.e., dual service applications, the fluid flow path assembly may include a relief line 145, e.g., a common header pipe, in fluid communication with each of the non-linear sections 106, 116, and disposed between the fluid openings 105 and 115 and the non-linear sections 106, 116. Suitably, the relief line 145 is operationally configured to discharge or vent out from the system 10 gas and/or fluid via fluid opening or outlet 147 to a discharge point apart from the system 10, e.g., discharge fluid to a storage tank in fluid communication with the system 10. As shown in FIG. 17, the relief line 145 may include a pressure relief valve 150 such as a pop off valve or the like fluidly connected at a point between each of the non-linear sections 106, 116 and the outlet 147. A suitable pressure relief valve 150 may include, but is not necessarily limited to a pressure relief valve such as a pop off valve, for example, a Fisher® valve commercially available from Emerson Electric Co., St. Louis, Mo., U.S.A. In oil and gas related operations and other industrial applications, one particular pressure relief valve may include 5.08 cm (2.0 inch) threads for threadedly securing to a mating flange. The various flanged connections of the pressure relief valve 150 may also include one or more sealing members, such as gaskets, O-rings, and combinations thereof as understood in the art of industrial pipe fittings. In oil and gas related operations and other industrial applications, one suitable pressure relief valve 150 pressure set point, i.e., maximum allowable working pressure, for an embodiment of the present system 10 for cooling compressed gas and/or pressurized fluids may include a PSV pressure set point of or about 9928.5 kPa (1440.0 psi). As understood by the skilled artisan, the PSV pressure set point or maximum allowable working pressure may be changed as desired. For example, in oil and gas related operations for cooling compressed gas and pressurized fluids the PSV pressure set point or maximum allowable working pressure may range from 1034.2 kPa to 41368.5 kPa (150.0 psi to 6000.0 psi).

Referring to FIG. 16, the fluid flow path assembly of the system 10 may also include a cover member 155 disposed above the chamber 131, and header members 132, 133 as desired, operationally configured to protect the cooling section 130 and the blower units 70, 80 and 90 from environmental damage such as hail damage, wind generated sand, debris, as well as animal droppings, rocks, tools and/or other items that may fall from a height above the system 10. The cover member 155 may be secured to one or more of the blower units 70, 80, 90 via removable fasteners. Suitable removable fasteners include, but are not necessarily limited to metal fasteners such as nut/bolt type fasteners, threaded screws, and combinations thereof. In one suitable embodiment, a cover member 155 may include a metal screen. One exemplary metal screen may include a mesh screen. Another exemplary metal screen may include a perforated mesh sheet. In another suitable embodiment, the cover member 155 may include metal angled fins similar as found in the art of air filter screens.

The system 10 may also include louvers disposed along the outer surface of the cover member 155, operated either manually, i.e., by hand via a lever, or remotely via a pneumatic actuator controlled by one or more temperature sensors located at or near the forced air outlets 170, 171, 172. Suitable louvers may be constructed from one or more materials as desired or as otherwise required for one or more particular system 10 operations. In oil and gas related operations and other industrial applications, the louvers may include auto louvers constructed from one or more metals including, but not necessarily limited to steel, aluminum, e.g., cast aluminum, or combinations thereof. One particular auto louver may be constructed from galvanized steel and include a seal along the leading edge of each blade, e.g., a rubber seal, a felt seal, for weather protection.

Referring to FIGS. 4 and 17, the fluid openings 105, 115 and the vent members 136 and 141 (FIG. 4) or the fluid openings 105, 115, the relief line 145 and outlet 147 (FIG. 17) are suitably located at or near the second end 28 of the main support member 15 and the power source 35 is suitably located at or near the first end 27 of the main support member 15 adjacent an opposite end of the blower assembly. Said another way, the blower assembly is located between the power source 35 and the fluid openings 105, 115, relief line 145 and outlet 147. By locating the power source 35 adjacent an opposite end of the blower assembly apart from the fluid openings 105, 115, the vent members 136 and 141, the relief line 145 and outlet 147, any ignition source of the power source 35 is suitably located as far away as possible from any gas that may leak out from the fluid openings 105, 115 and/or any gas that may be vented out through the vent members 136 and 141 or the outlet 147 thereby eliminating or otherwise diminishing the opportunity for ignition of any gases emitted from the system 10. Moreover, by locating the power source 35 at or near the first end 27 of the main support member 15 personnel may work on the power source 35 and/or other items located at or near the first end 27 of the main support member 15 without being located in dangerous proximity of any pressurized parts of the fluid flow path assembly of the system 10 located at or near the second end 28 of the main support member 15, as well as a pipeline 200 and any pressurized fluid connectors fluidly connecting the system 10 with a pipeline 200. In this regard, the blower assembly may act as a protective physical barrier between the power source 35 and any pressurized conduits of the fluid flow path assembly located at or near the second side 28 of the main support member 15, a pipeline 200 and any pressurized fluid connectors fluidly connecting the system 10 with a pipeline 200.

As stated, in oil and gas type operations the system 10 may be provided in a shape and size suitable for roadway transportation via a flatbed truck, drop trailer or the like to a desired location for fluidly connecting to an existing high temperature fluid and/or high pressure pipeline 200. As understood by the skilled artisan, existing oil and gas type pipelines 200 are typically provided or equipped with a manifold type member with fluid connections for fluidly connecting a heat exchanger to the pipeline 200 and for routing fluid out from an upstream point along the pipeline 200 into the heat exchanger and then back into the pipeline 200 at a different point downstream along the pipeline 200 once the fluid has flowed through the heat exchanger. As shown in FIG. 1, known heat exchangers 700 at the time of this application include a skid mounted vertical fan 702 with an air intake 704 facing in a manner effective to receive the maximum ambient airflow directly into the air intake 704, e.g., an air intake 704 facing south to receive southern winds traveling north directly into the air intake 704, thereby minimizing the opportunity for heated air to be recirculated back through the air intake 704 (see the position of engine 706 opposite the position of the air intake 704 in FIG. 1). In addition to the air intake 704 suitably being oriented to face and receive oncoming winds, for fluid cooling purposes it is also desirable that a known heat exchanger 700 receive fluid from a pipeline 200 at an upstream location via a pipeline outlet 708 and discharge cooled fluid back into the pipeline 200 at a downstream position via a pipeline inlet 710. As a result, heat exchangers 700 located on the east side of a pipeline 200 include a different setup compared to heat exchangers 700 located on the west side of the pipeline 200 as shown in FIG. 1. In particular, heat exchangers 700 located on the west side of a pipeline 200 include inlet fluid piping 712 that necessarily crosses over outlet fluid piping 714. Regardless of location, known heat exchangers 700 require undesired quantities of fluid piping for proper installation, which typically requires unwanted added time, e.g., man hours, for installation in order to make such a heat exchanger 700 operational. In addition, added fluid piping may have to be purchased and transported to a site of operation requiring additional cost and time. Moreover, a known heat exchanger 700 cannot typically be provided for installation along a pipeline 200 by including a predetermined type and/or quantity of fluid piping and/or fittings and/or valves as the demand for such materials may vary from site to site according to the directional layout of the pipeline 200, e.g., a pipeline 200 running southwest to northeast.

Figure 18:
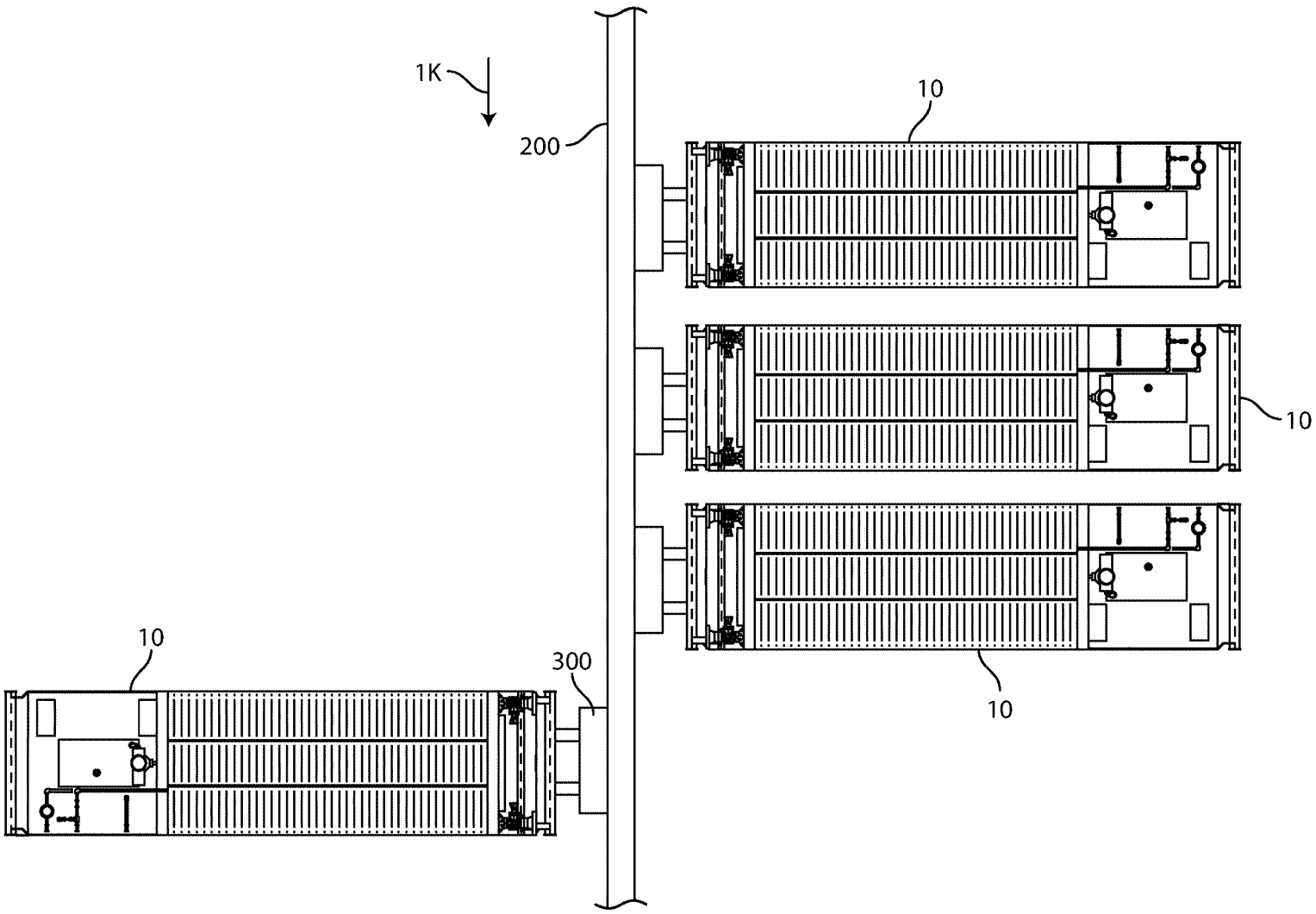
FIG. 18 is a top view illustrating a plurality of exemplary systems of this application in operation collectively for cooling fluid from a common pipeline at an operation site.
Figure 19:
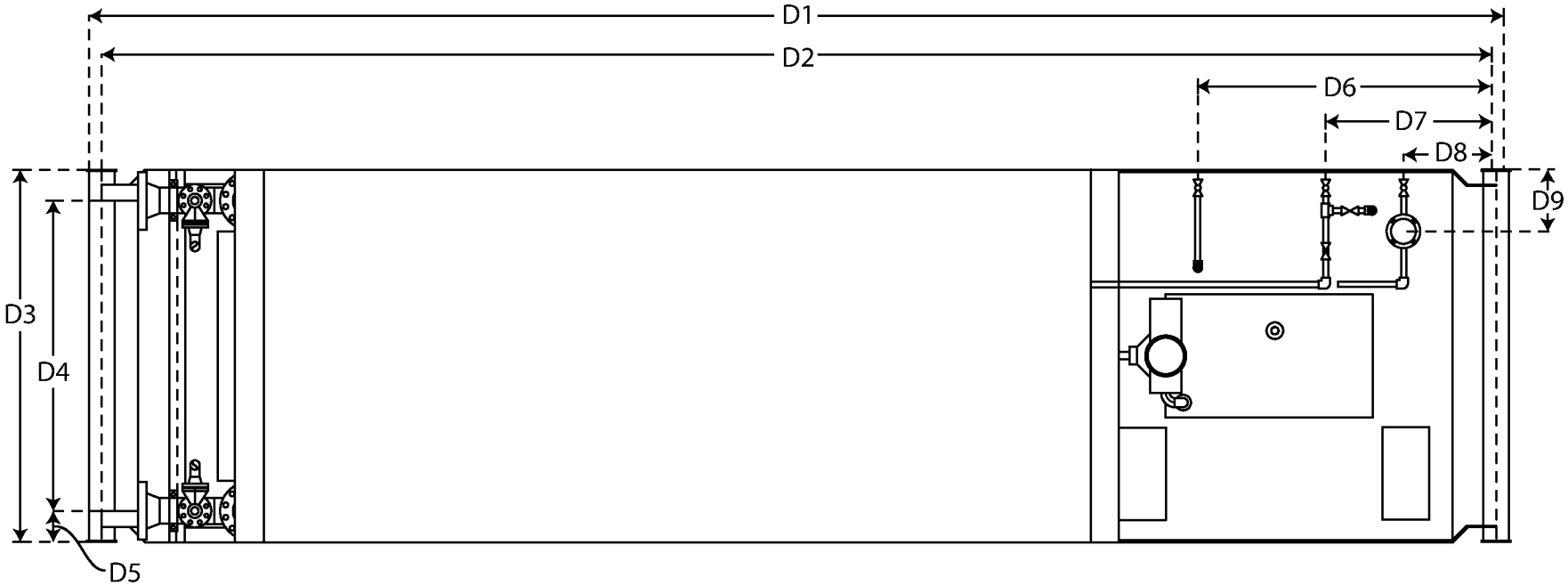
FIG. 19 is a top view of an embodiment of a system of this application operationally configured for cooling compressed gas.
Figure 20:
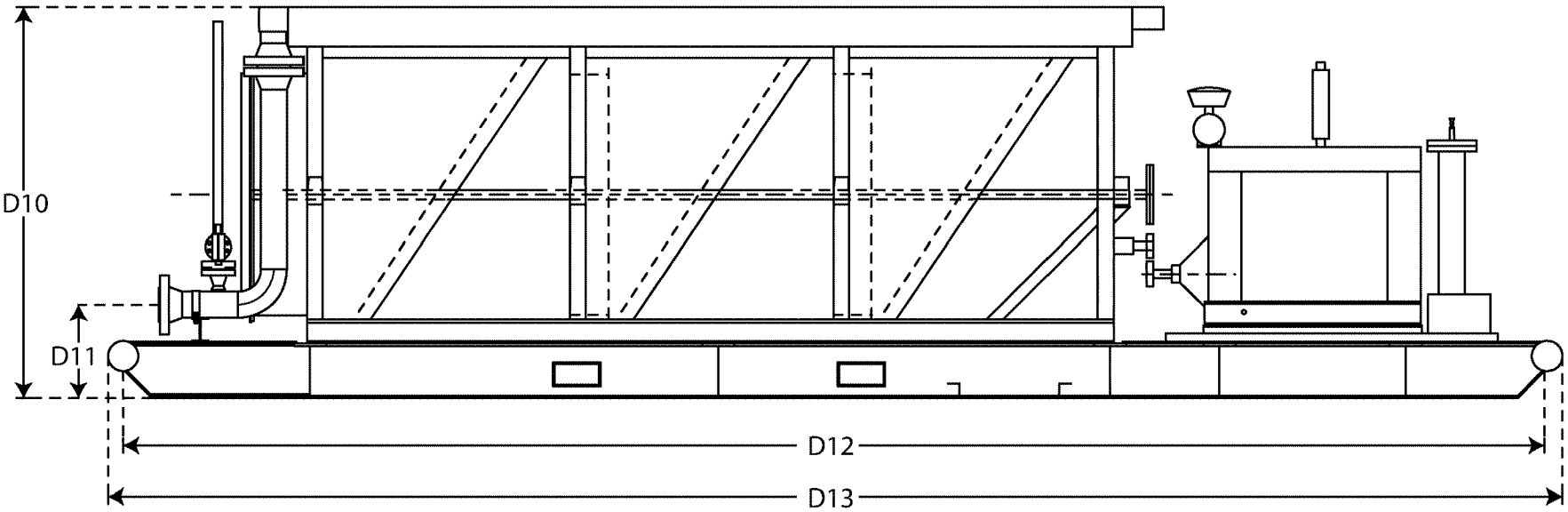
FIG. 20 is a side elevation view of the system of FIG. 19.
Figure 21:
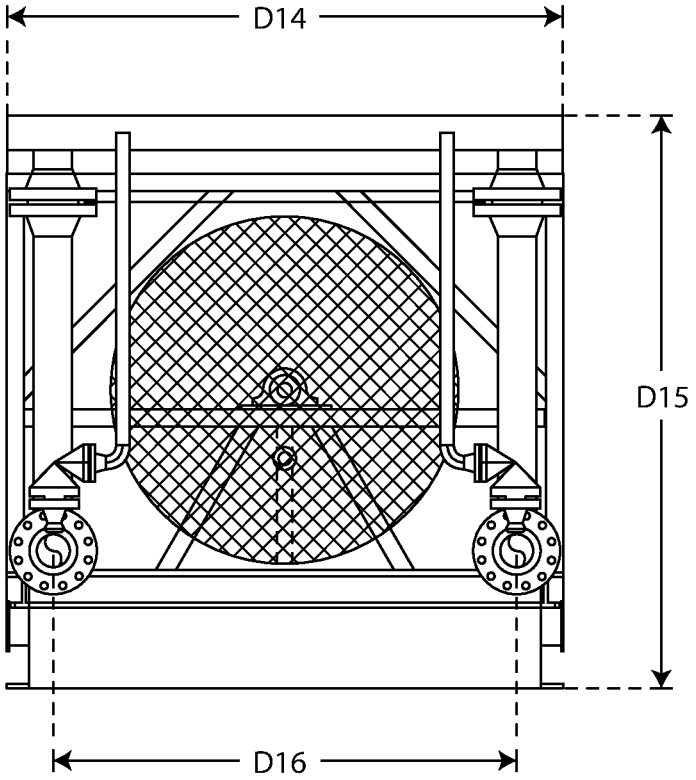
FIG. 21 is an end view of the system of FIG. 19.
Figure 22:
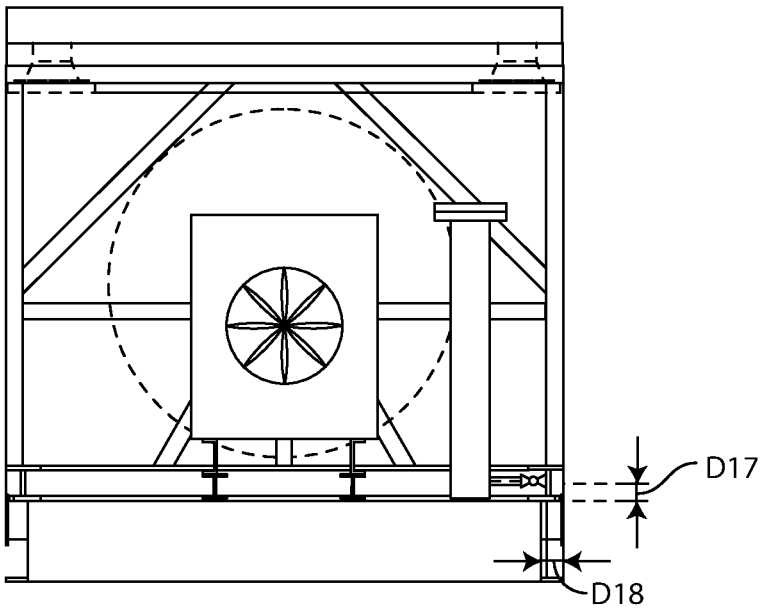
FIG. 22 is an opposing end view of the system of FIG. 19.
Figure 23:
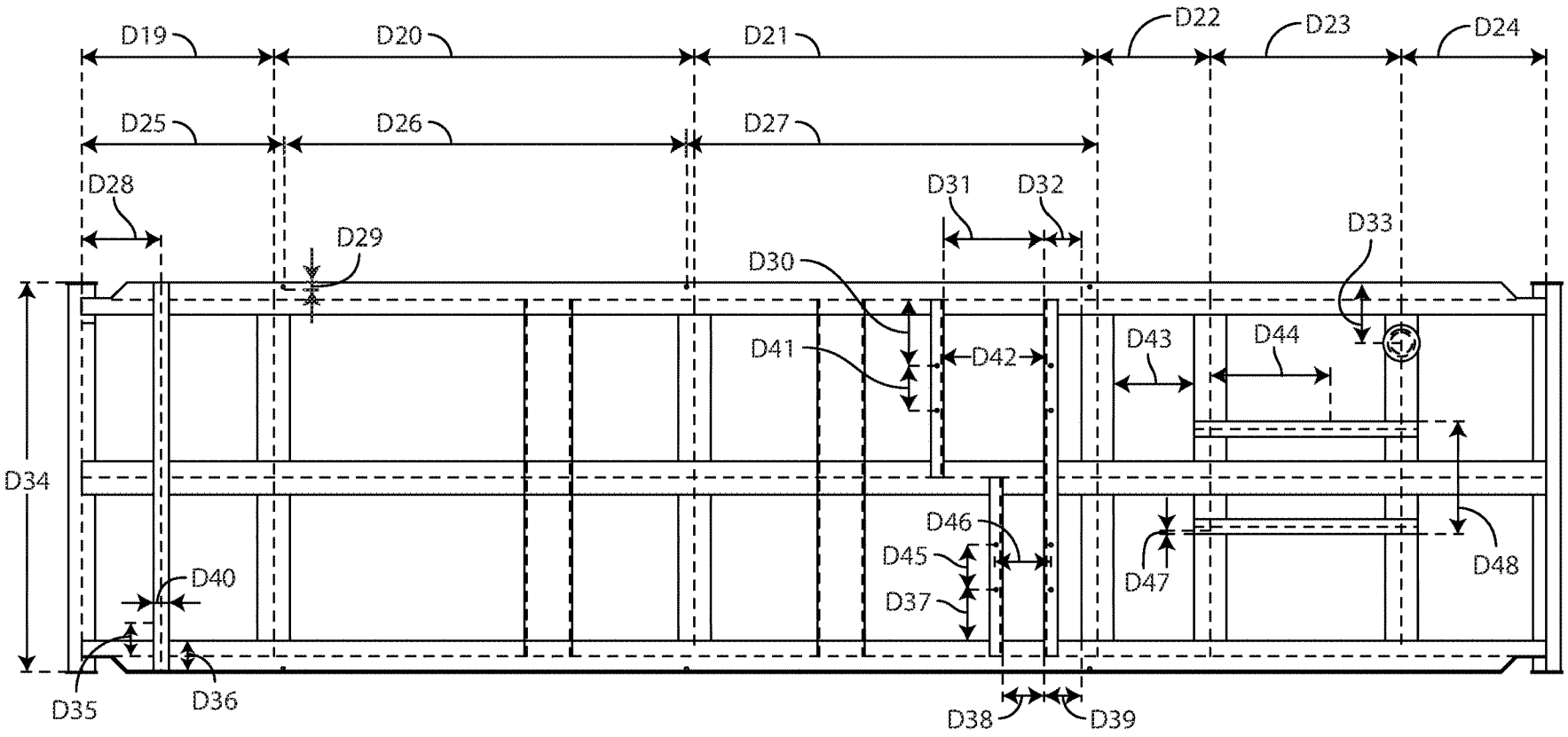
FIG. 23 is a top view of a main support member of the system of FIG. 19.
Figure 24:
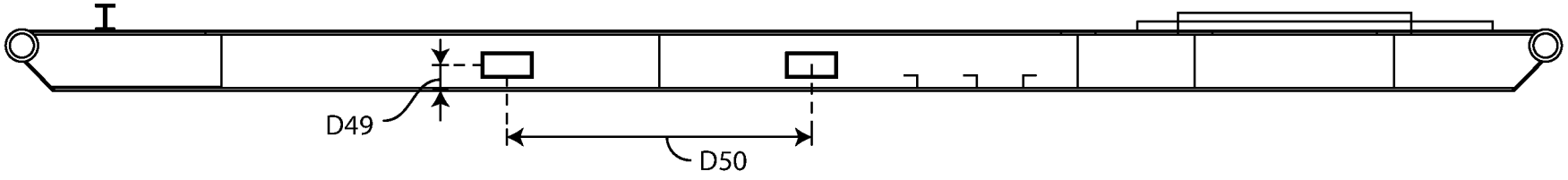
FIG. 24 is a side view of the main support member of FIG. 23.
Figure 25:
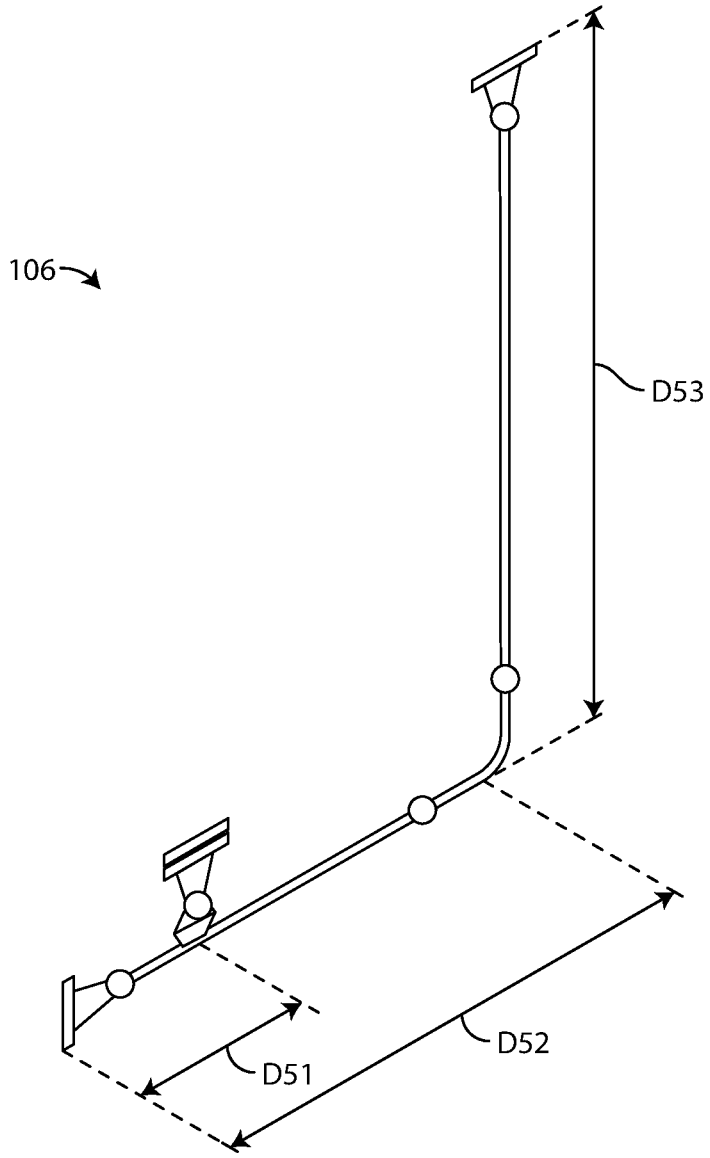
FIG. 25 is a perspective view of a simplified illustration of a non-linear section of the system of FIG. 19.

With reference to FIG. 18, by including (1) fluid openings 105, 115 in proximity on a similar end of the main support member 15 and (2) blower units 70, 80 with openings 78 and 88 on either side of the blower units 70 and 80, the orientation of the present system 10 is not dependent on wind direction or other directional layout of a particular pipeline 200. In addition, the inclusion of fluid openings 105, 115 on a similar end of the main support member 15 allows the system 10 to be removed directly from a flatbed or the like at a point of direct plug-in type installation with a pipeline 200 without employing the quantities of fluid piping that is required in known installations as depicted in FIG. 1. For example, the present system 10 does not require the length of added fluid piping running to a far end of the system 10 apart from the pipeline 200 as illustrated in the example of FIG. 1. In oil and gas type operations, the present system 10 is operationally configured to be located less than a meter from a pipeline 200 or a pipeline manifold 300 connected thereto. In particular, the fluid openings 105, 115 may be located within one meter or less from a corresponding fluid inlet and outlet of a pipeline 200 or a pipeline manifold 300 whereby the system 10 may employ a known constant size and type of fluid connectors, e.g., fluid piping and/or fittings and/or valves for use with the system 10. As understood by the skilled artisan, if a scenario arises requiring any additional fluid piping and/or fittings and/or valves, such may easily be added for use with the system 10.

In addition, because each of the fluid openings 105 and 115 are operational as a fluid inlet or fluid outlet, the present system 10 is not limited to operation along one side of a pipeline 200 or the other. As further depicted in FIG. 18, the perimeter size and shape of the system 10 allows a plurality of systems 10 to be aligned adjacent one another along a pipeline 200 for cooling operations in close proximity. In oil and gas type operations, each system 10 may be installed as close as 1.22 meters (4.0 feet) to adjacent system(s) 10 thereby minimizing the footprint at an operation site employing two or more systems 10—see FIG. 18 where directional arrow 1K indicates the direction of fluid flow in the pipeline 200.

The disclosure will be better understood with reference to the following non-limiting examples, which are illustrative only and not intended to limit the present disclosure to a particular embodiment.

Example 1

In a first non-limiting example, a system 10 as shown in FIGS. 19-25 operationally configured for cooling compressed gas in oil and gas related operations is provided having a total of three blower units 70, 80, 90 with the dimensions and specifications as described in Table 1.

TABLE 1

| | |
|---|---|
| D1: | 9.34 m (367.625 inches); |
| D2: | 9.14 m (360.0 inches); |
| D3: | 2.44 m (96.0 inches); |
| D4: | 2.03 m (80.0 inches); |
| D5: | 0.203 m (8.0 inches); |
| D6: | 1.96 m (77.0 inches); |
| D7: | 1.12 m (44.0 inches); |
| D8: | 0.61 m (24.0 inches); |
| D9: | 0.41 m (16.0 inches); |
| D10: | 2.51 m (98.875 inches); |
| D11: | 0.60 m (23.625 inches); |
| D12: | 9.14 m (360.0 inches); |
| D13: | 9.34 m (367.625 inches); |
| D14: | 2.43 m (95.625 inches); |
| D15: | 2.51 m (98.875 inches); |
| D16: | 2.03 m (80.0 inches); |
| D17: | 0.08 m (3.0 inches); |
| D18: | 0.08 m (3.0 inches); |
| D19: | 1.2 m (47.375 inches); |
| D20: | 2.62 m (103.19 inches); |
| D21: | 2.51 m (99.0 inches); |
| D22: | 0.70 m (27.69 inches); |
| D23: | 1.19 m (46.94 inches); |
| D24: | 0.91 m (35.75 inches); |
| D25: | 1.26 m (49.5 inches); |
| D26: | 2.51 m (99.0 inches); |
| D27: | 2.51 m (99.0 inches); |
| D28: | 0.50 m (19.5 inches); |
| D29: | 0.0254 m (1.0 inches); |
| D30: | 0.41 m (16.31 inches); |
| D31: | 0.64 m (25.0 inches); |
| D32: | 0.23 m (9.0 inches); |
| D33: | 0.38 m (15.0 inches); |
| D34: | 2.44 m (96.0 inches); |
| D35: | 0.22 m (8.625 inches); |
| D36: | 0.08 m (3.19 inches); |
| D37: | 0.40 m (15.81 inches); |
| D38: | 0.27 m (10.5 inches); |
| D39: | 0.23 m (9.0 inches); |
| D40: | 0.024 m (0.94 inches); |
| D41: | 0.28 m (11.0 inches); |
| D42: | 0.71 m (28.0 inches); |
| D43: | 0.097 m (3.81 inches); |
| D44: | 0.79 m (31.0 inches); |
| D45: | 0.30 m (12.0 inches); |
| D46: | 0.34 m (13.5 inches); |
| D47: | 0.0254 m (1.0 inches); |
| D48: | 0.71 m (28.0 inches); |
| D49: | 0.15 m (6.0 inches); |
| D50: | 1.83 m (72.0 inches); |
| D51: | 0.38 m (15.0 inches); |
| D52: | 0.74 m (29.0 inches); |
| D53: | 1.53 m (60.16 inches); |
| System 10 Total Weight: of or about 9525.4 kg (21,000.0 pounds). | |

Example 2

Figure 26:
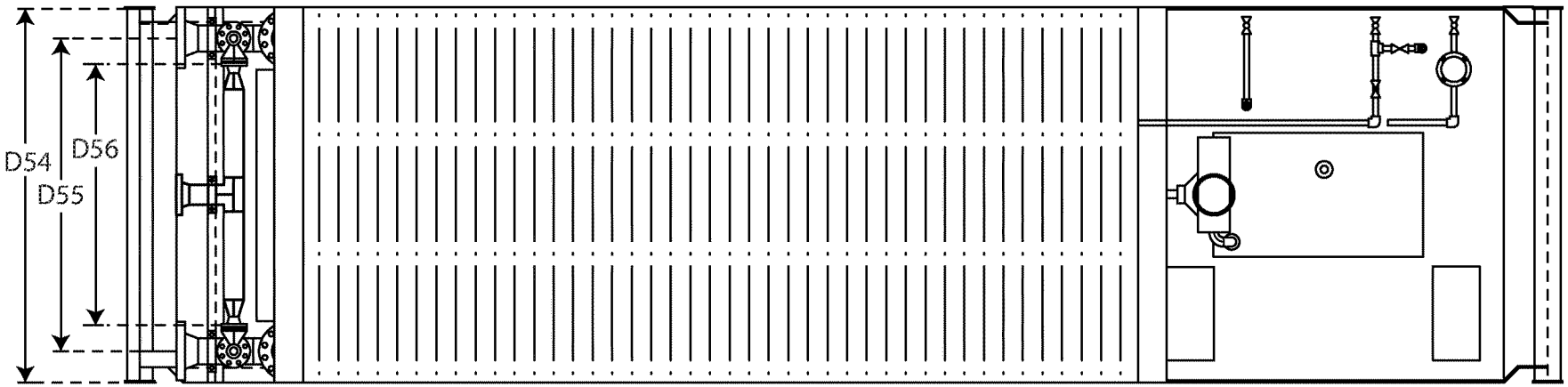
FIG. 26 is a top view of another embodiment of a system of this application operationally configured for cooling compressed gas and pressurized fluid.

In a second non-limiting example, a system 10 as shown in FIG. 26 operationally configured for cooling compressed gas and pressurized fluid in oil and gas related operations is provided with a total of three blower units 70, 80, 90 and a relief line 145 and has dimensions as described in Table 2.

TABLE 2

| | |
|---|---|
| D54: | 2.44 m (96.0 inches); |
| D55: | 2.03 m (80.0 inches); |
| D56: | 1.72 m (67.88 inches). |

Example 3

Figure 27:
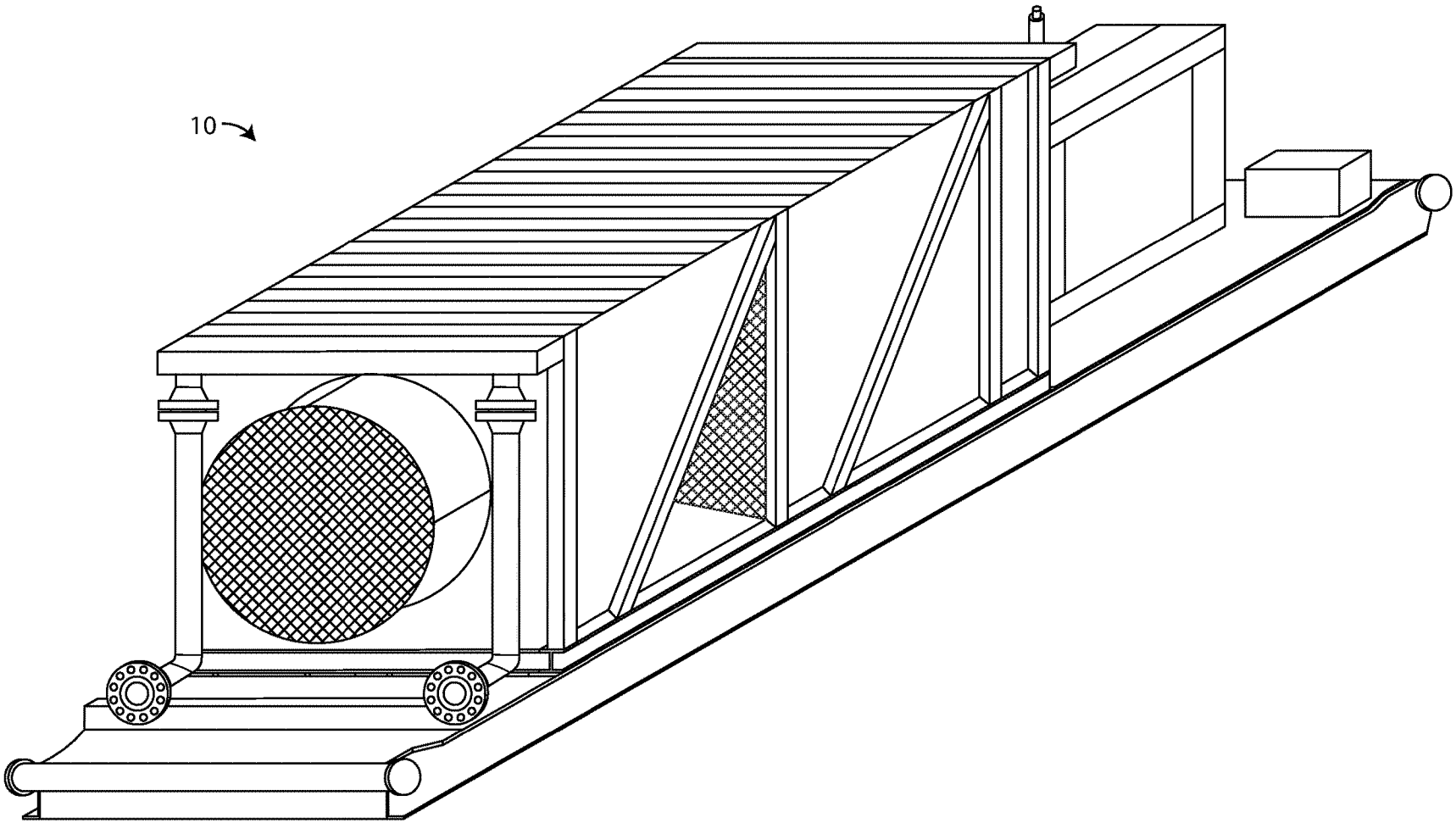
FIG. 27 is a perspective view of another embodiment of a system of this application operationally configured for cooling compressed gas and pressurized fluid.
Figure 28:
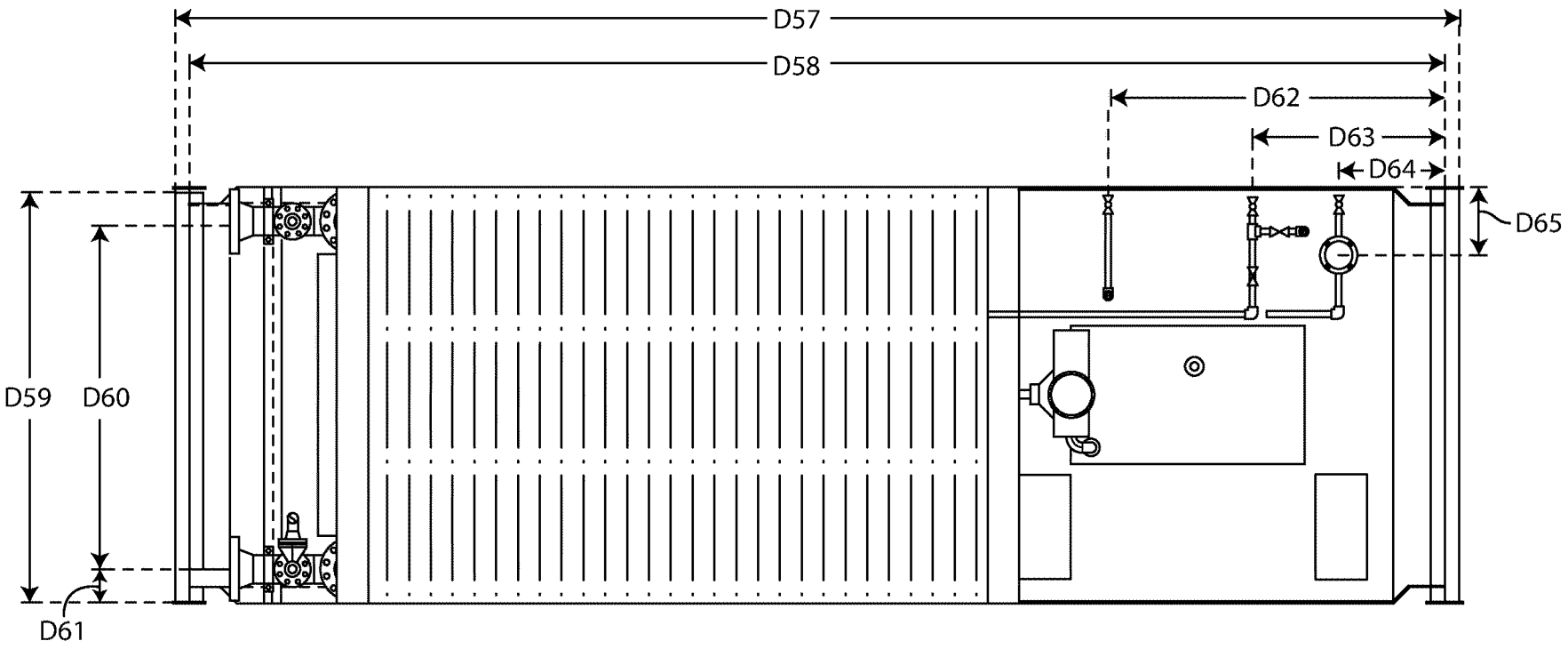
FIG. 28 is a top view of the system of FIG. 27.
Figure 29:
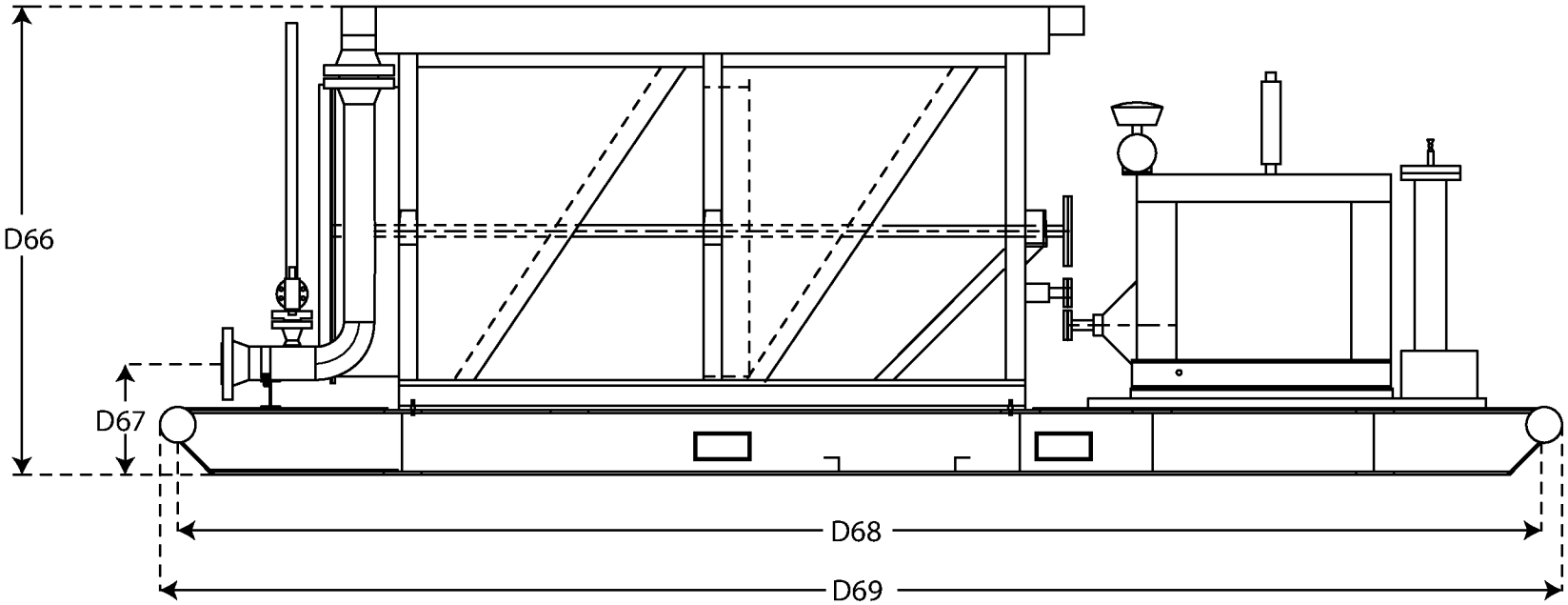
FIG. 29 is a side elevation view of the system of FIG. 27.
Figure 30:
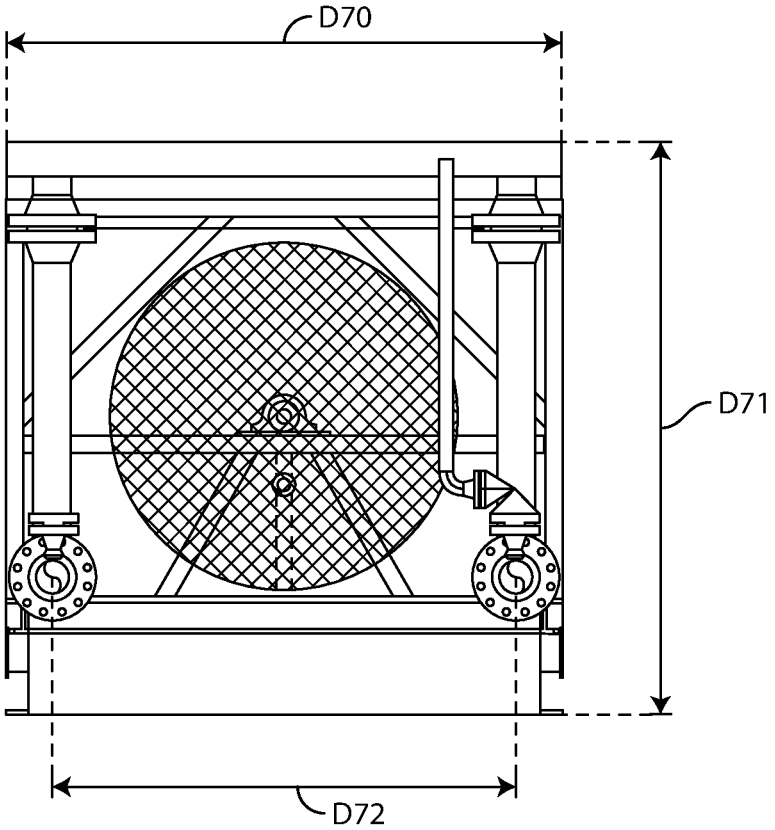
FIG. 30 is an end view of the system of FIG. 27.
Figure 31:
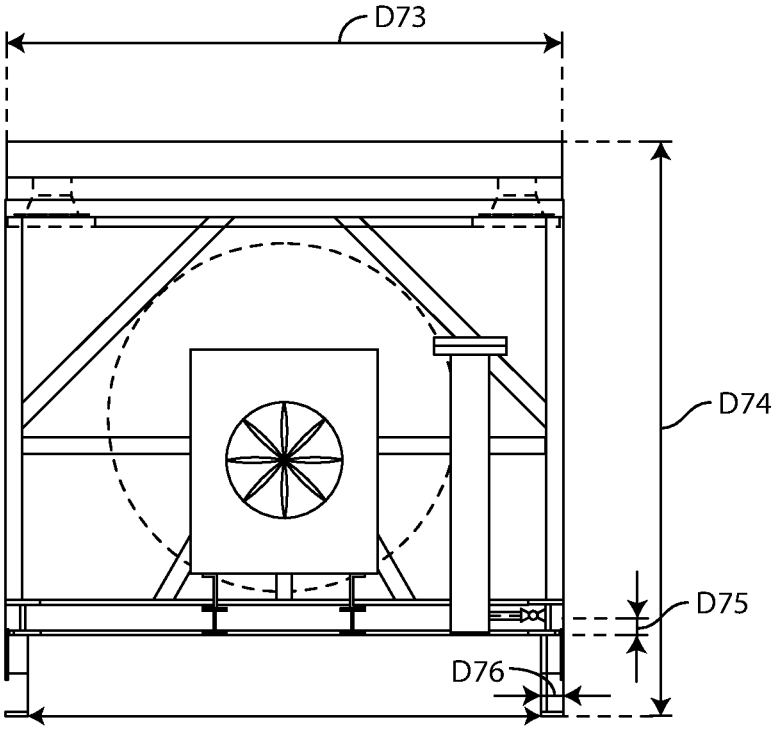
FIG. 31 is an opposing end view of the system of FIG. 27.
Figure 32:
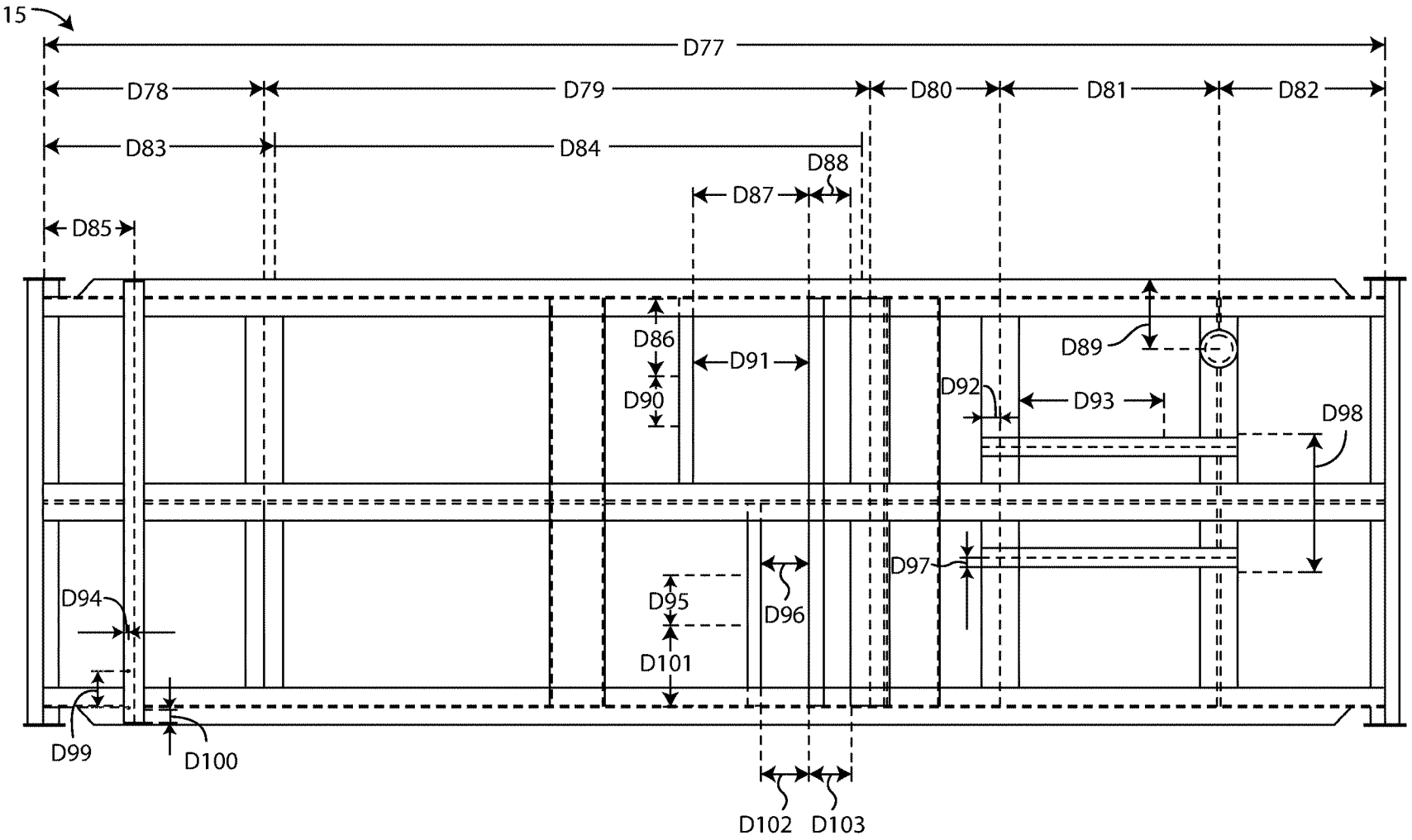
FIG. 32 is a top view of the main support member of the system of FIG. 27.
Figure 33:
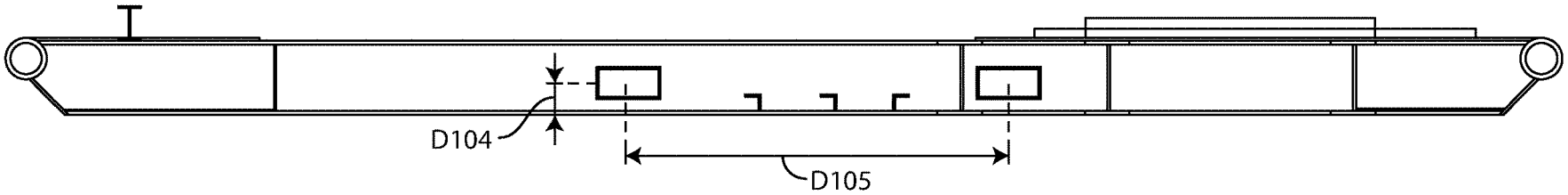
FIG. 33 is a side view of the main support member of FIG. 32.
Figure 34:
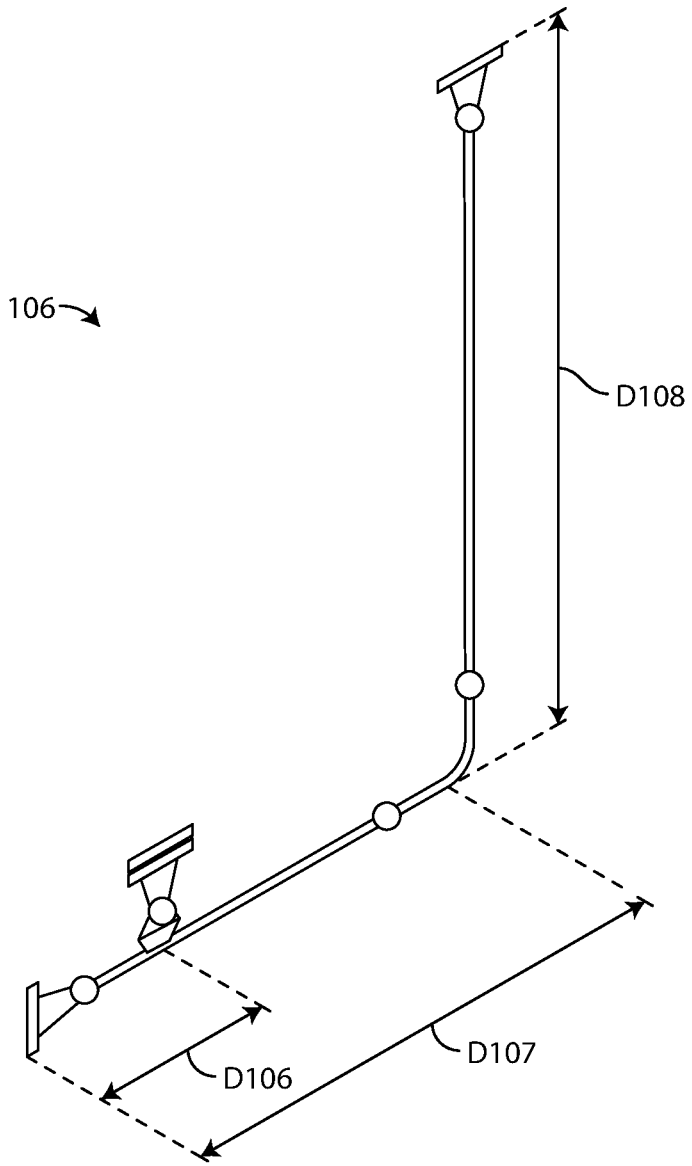
FIG. 34 is a perspective view of a simplified illustration of a non-linear section of the system of FIG. 27.
Figure 35:
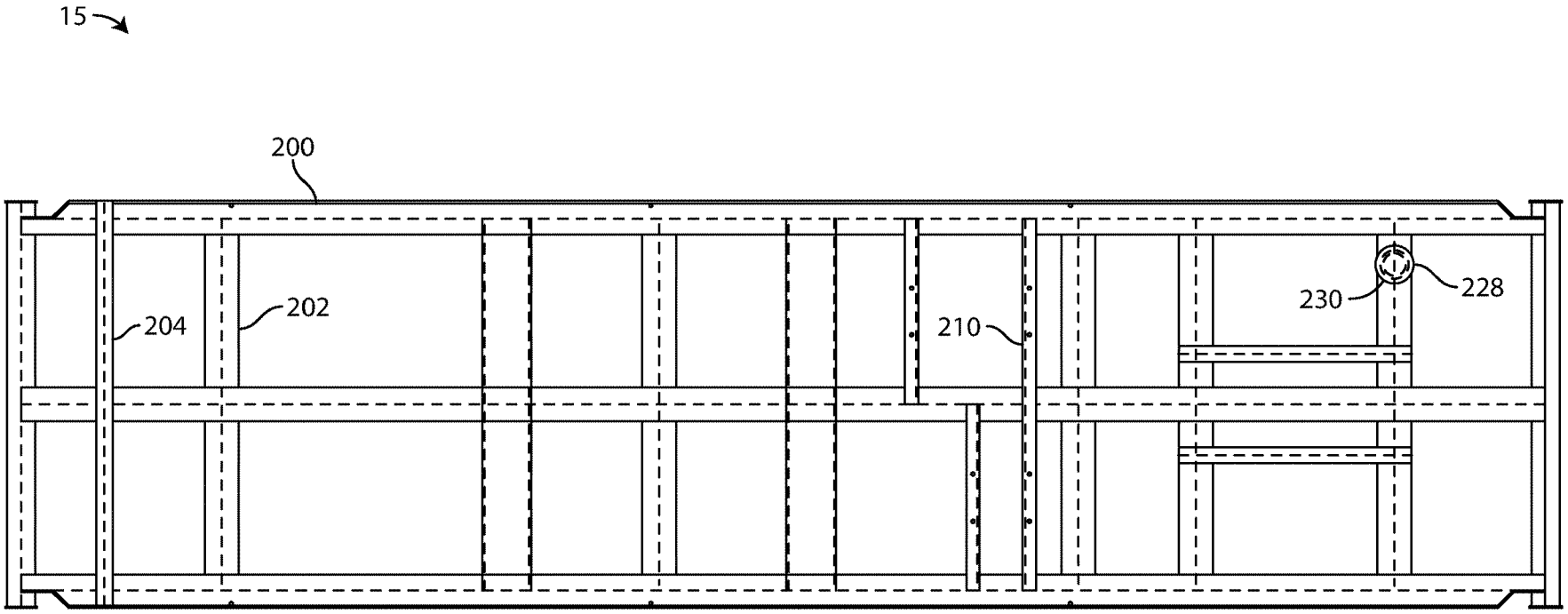
FIG. 35 is a top view of a main support member of an embodiment of the present system as shown in FIG. 2.
Figure 36:
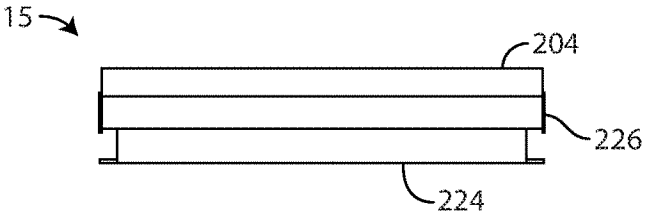
FIG. 36 is an end view of the main support member of FIG. 35.
Figure 37:
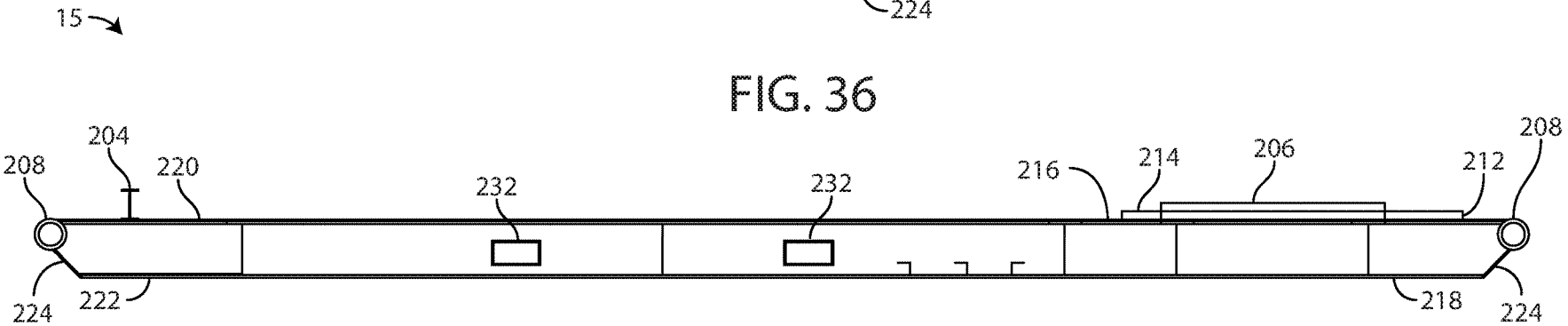
FIG. 37 is a side view of the main support member of FIG. 35.
Figure 38:
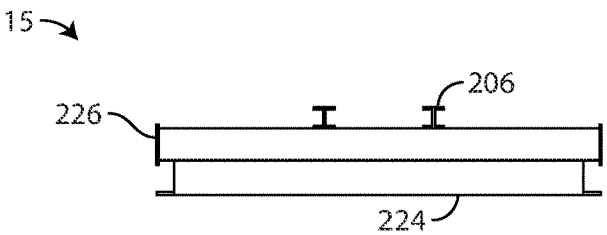
FIG. 38 is an opposing end view of the main support member of FIG. 35.
Figure 39:
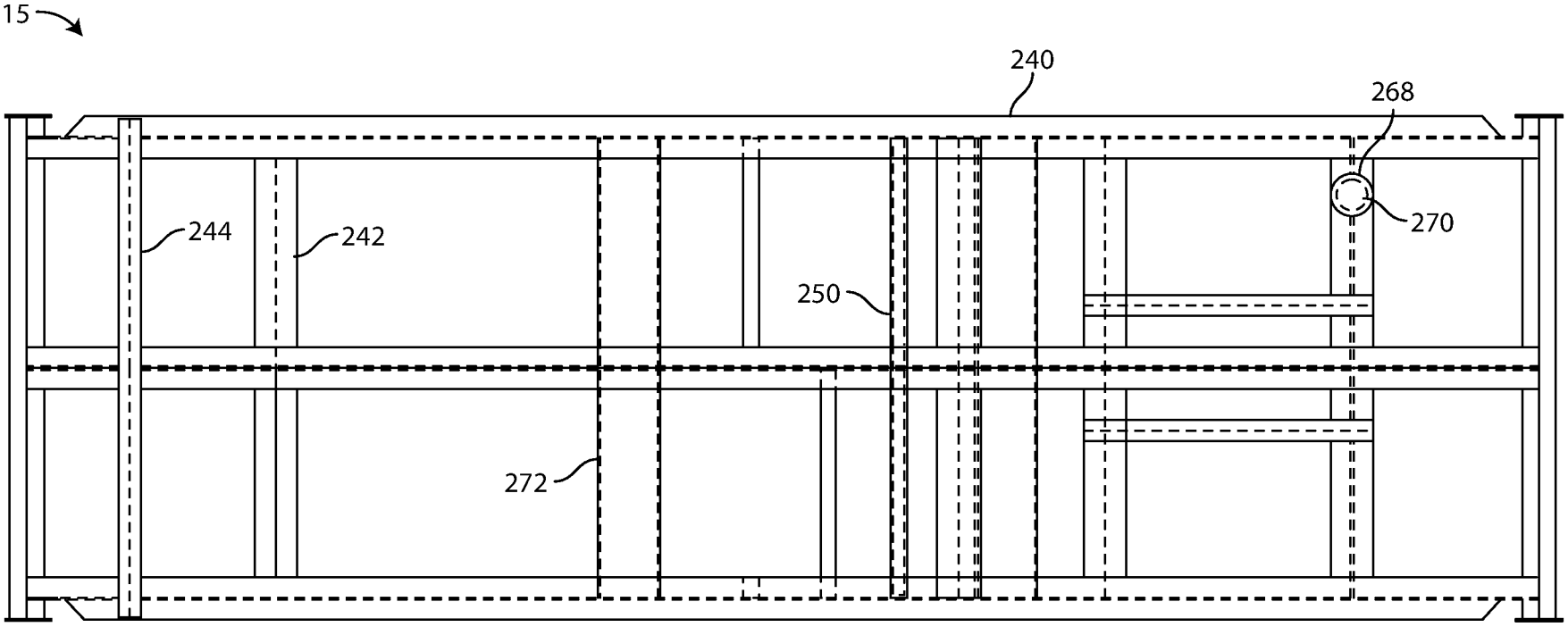
FIG. 39 is a top view of a main support member of an embodiment of the present system as shown in FIG. 27.
Figure 40:
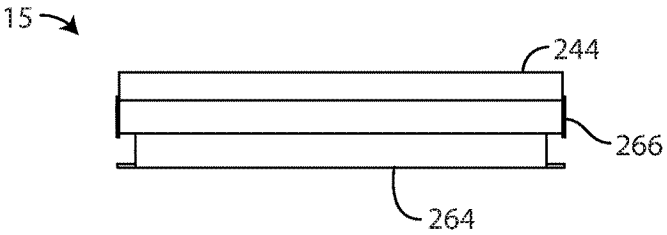
FIG. 40 is an end view of the main support member of FIG. 39.
Figure 41:
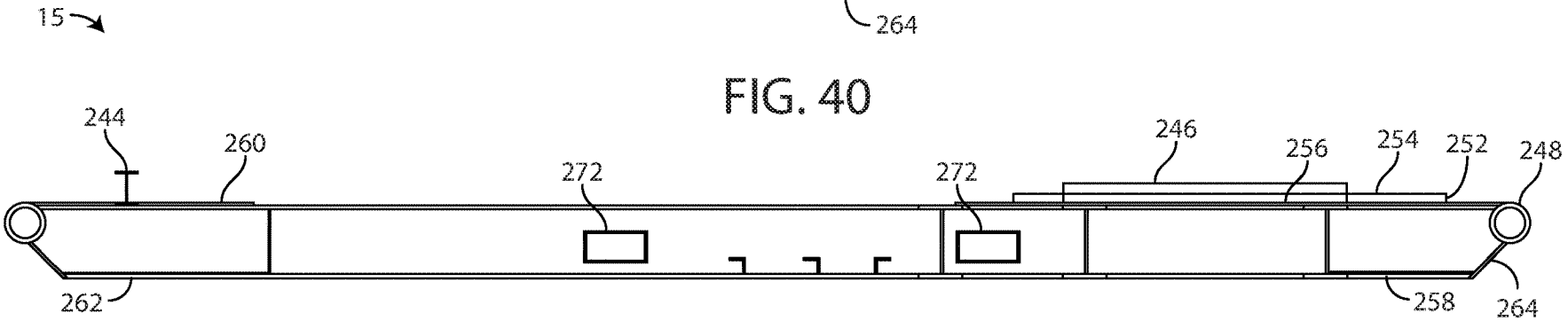
FIG. 41 is a side view of the main support member of FIG. 39.
Figure 42:
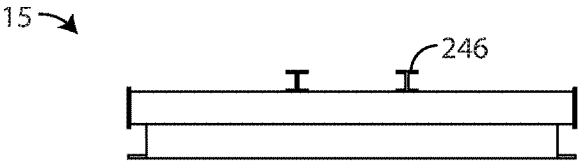
FIG. 42 is an opposing end view of the main support member of FIG. 39.

In a third non-limiting example, a system 10 as shown in FIG. 27 operationally configured for cooling compressed gas in oil and gas related operations is provided having a total of two blower units 70, 80. With attention to FIGS. 28-34, a system 10 as shown in FIG. 27 includes dimensions and specifications as described in Table 3.

TABLE 3

| | |
|---|---|
| D57: | 7.51 m (295.625 inches); |
| D58: | 7.31 m (288.0 inches); |
| D59: | 2.43 m (96.0 inches); |
| D60: | 2.03 m (80.0 inches); |
| D61: | 0.20 m (8.0 inches); |
| D62: | 1.96 m (77.0 inches); |
| D63: | 1.12 m (44.0 inches); |
| D64: | 0.61 m (24.0 inches); |
| D65: | 0.41 m (16.0 inches); |
| D66: | 2.51 m (98.875 inches); |
| D67: | 0.60 m (23.625 inches); |
| D68: | 7.32 m (288.0 inches); |
| D69: | 7.51 m (295.625 inches); |
| D70: | 2.43 m (95.625 inches); |
| D71: | 2.51 m (98.875 inches); |
| D72: | 2.03 m (80.0 inches); |
| D73: | 2.43 m (95.625 inches); |
| D74: | 2.51 m (98.875 inches); |
| D75: | 0.07 m (3.0 inches); |
| D76: | 0.07 m (3.0 inches); |
| D77: | 7.31 m (288.0 inches); |
| D78: | 1.20 m (47.375 inches); |
| D79: | 3.31 m (130.19 inches); |
| D80: | 0.70 m (27.69 inches); |
| D81: | 1.19 m (46.98 inches); |
| D82: | 0.91 m (35.75 inches); |
| D83: | 1.26 m (49.5 inches); |
| D84: | 3.20 m (126.0 inches); |
| D85: | 0.50 m (19.5 inches); |
| D86: | 0.41 m (16.31 inches); |
| D87: | 0.64 m (25.0 inches); |
| D88: | 0.23 m (9.0 inches); |
| D89: | 0.38 m (15.0 inches); |
| D90: | 0.28 m (11.0 inches); |
| D91: | 0.71 m (28.0 inches); |
| D92: | 0.10 m (3.81 inches); |
| D93: | 0.94 m (37.0 inches); |
| D94: | 0.02 m (0.94 inches); |
| D95: | 0.30 m (12.0 inches); |
| D96: | 0.34 m (13.5 inches); |
| D97: | 0.0254 m (1.0 inches); |
| D98: | 0.71 m (28.0 inches); |
| D99: | 0.22 m (8.625 inches); |
| D100: | 0.08 m (3.19 inches); |
| D101: | 0.40 m (15.81 inches); |
| D102: | 0.27 m (10.5 inches); |
| D103: | 0.23 m (9.0 inches); |
| D104: | 0.15 m (6.0 inches); |
| D105: | 1.83 m (72.0 inches); |
| D106: | 0.38 m (15.0 inches); |
| D107: | 0.74 m (29.0 inches); |
| D108: | 1.53 m (60.16 inches); |
| System 10 Total Weight: of or about 8164.7 kg (18,000.0 pounds). | |

Example 4

In a fourth non-limiting example, a system 10 operationally configured for cooling compressed gas in oil and gas related operations is provided having a total of three blower units 70, 80, 90 with a main support member 15 as shown in FIGS. 35-38 constructed from materials including, but not necessarily limited to the materials as described in Table 4.

TABLE 4

| Quantity | Item Description |
|---|---|
| 3 | Wide Flange Beam 200; ASTM A992;<br>Nominal size: 0.36 × 1.35 m (14.0 × 53.0 inches);<br>Length: 9.14 m (360.0 inches). |

TABLE 4-continued

| Quantity | Item Description |
|---|---|
| 10 | Wide Flange Beam 202; ASTM A992; Nominal size: 0.36 × 1.35 m (14.0 × 53.0 inches); Length: 1.11 m (43.56 inches). |
| 1 | Wide Flange Beam 204; ASTM A992; Nominal size: 0.15 × 0.30 m (6.0 × 12.0 inches); Length: 2.41 m (95.0 inches). |
| 2 | Wide Flange Beam 206; ASTM A992; Nominal size: 0.10 × 0.33 m (4.0 × 13.0 inches); Length: 1.40 m (55.0 inches). |
| 2 | Pipe (Schedule 80) 208; ASTM A53; Nominal Pipe Size: 0.15 m (6.0 inches); Length: 2.42 m (95.25 inches). |
| 4 | Angle Bar 210; ASTM A36; Leg 1: 0.08 m (3.0 inches); Leg 2: 0.08 m (3.0 inches); Thickness: 0.006 m (0.25 inches); Length: 1.11 m (43.56 inches). |
| 2 | Flat Bar 212; ASTM A36; Width: 0.0508 m (2.0 inches); Thickness: 0.006 m (0.25 inches); Length: 2.39 m (94.0 inches). |
| 2 | Flat Bar 214; ASTM A36; Width: 0.0508 m (2.0 inches); Thickness: 0.006 m (0.25 inches); Length: 2.13 m (84.0 inches). |
| 1 | Plate 216; ASTM A36; Width: 2.4 m (95.0 inches); Thickness: 0.0095 m (0.375 inches); Length: 2.74 m (108.0 inches). |
| 2 | Plate 218; ASTM A36; Width: 0.72 m (28.5 inches); Thickness: 0.0095 m (0.375 inches); Length: 1.09 m (43.0 inches). |
| 1 | Plate 220; ASTM A36; Width: 1.12 m (44.0 inches); Thickness: 0.0095 m (0.375 inches); Length: 2.41 m (95.0 inches). |
| 2 | Plate 222; ASTM A36; Width: 1.03 m (40.5 inches); Thickness: 0.0095 m (0.375 inches); Length: 1.09 m (43.0 inches). |
| 2 | Plate 224; ASTM A36; Width: 2.24 m (88.25 inches); Thickness: 0.0095 m (0.375 inches); Length: 3.05 m (120.125 inches). |
| 4 | Plate 226; ASTM A36; Diameter: 0.19 m (7.625 inches); Thickness: 0.0095 m (0.375 inches). |
| 1 | Plate 228; ASTM A36; Diameter: 0.22 m (8.625 inches); Thickness: 0.0095 m (0.375 inches). |
| 2 | Pipe (Schedule 80) 230; ASTM A53; Nominal Pipe Size: 0.10 m (4.0 inches); Length: 0.15 m (6.0 inches). |
| 2 | Rectangular Tube 232; ASTM A500; Width: 0.30 m (12.0 inches); Height: 0.15 m (6.0 inches); Thickness: 0.006 m (0.25 inches); Length: 2.29 m (90.0 inches); |

Example 5

In a fifth non-limiting example, a system 10 operationally configured for cooling compressed gas in oil and gas related operations is provided having a total of two blower units 70, 80 with a main support member 15 as shown in FIGS. 39-42 constructed from materials including, but not necessarily limited to the materials as described in Table 5.

TABLE 5

| Quantity | Item Description |
|---|---|
| 3 | Wide Flange Beam 240; ASTM A992; Nominal size: 0.36 × 1.35 m (14.0 × 53.0 inches); Length: 7.32 m (288.0 inches). |
| 10 | Wide Flange Beam 242; ASTM A992; Nominal size: 0.36 × 1.35 m (14.0 × 53.0 inches); Length: 1.11 m (43.56 inches). |
| 1 | Wide Flange Beam 244; ASTM A992; Nominal size: 0.15 × 0.30 m (6.0 × 12.0 inches); Length: 2.41 m (95.0 inches). |
| 2 | Wide Flange Beam 246; ASTM A992; Nominal size: 0.10 × 0.33 m (4.0 × 13.0 inches); Length: 1.40 m (55.0 inches). |
| 2 | Pipe (Schedule 80) 248; ASTM A53; Nominal Pipe Size: 0.15 m (6.0 inches); Length: 2.42 m (95.25 inches). |
| 4 | Angle Bar 250; ASTM A36; Leg 1: 0.08 m (3.0 inches); Leg 2: 0.08 m (3.0 inches); Thickness: 0.006 m (0.25 inches); Length: 1.11 m (43.56 inches). |
| 2 | Flat Bar 252; ASTM A36; Width: 0.05 m (2.0 inches); Thickness: 0.006 m (0.25 inches); Length: 2.39 m (94.0 inches). |
| 2 | Flat Bar 254; ASTM A36; Width: 0.05 m (2.0 inches); Thickness: 0.006 m (0.25 inches); Length: 2.13 m (84.0 inches). |
| 1 | Plate 256; ASTM A36; Width: 2.4 m (95.0 inches); Thickness: 0.0095 m (0.375 inches); Length: 2.74 m (108.0 inches). |
| 2 | Plate 258; ASTM A36; Width: 0.72 m (28.5 inches); Thickness: 0.0095 m (0.375 inches); Length: 1.09 m (43.0 inches). |
| 1 | Plate 260; ASTM A36; Width: 1.12 m (44.0 inches); Thickness: 0.0095 m (0.375 inches); Length: 2.41 m (95.0 inches). |
| 2 | Plate 262; ASTM A36; Width: 1.03 m (40.5 inches); Thickness: 0.0095 m (0.375 inches); Length: 1.09 m (43.0 inches). |
| 2 | Plate 264; ASTM A36; Width: 2.24 m (88.25 inches); Thickness: 0.0095 m (0.375 inches); Length: 3.05 m (120.125 inches). |
| 4 | Plate 266; ASTM A36; Diameter: 0.19 m (7.625 inches); Thickness: 0.0095 m (0.375 inches). |
| 1 | Plate 268; ASTM A36; Diameter: 0.22 m (8.625 inches); Thickness: 0.0095 m (0.375 inches). |
| 2 | Pipe (Schedule 80) 270; ASTM A53; Nominal Pipe Size: 0.10 m (4.0 inches); Length: 0.15 m (6.0 inches). |
| 2 | Rectangular Tube 272; ASTM A500; Width: 0.30 m (12.0 inches); Height: 0.15 m (6.0 inches); Thickness: 0.006 m (0.25 inches); Length: 2.29 m (90.0 inches); |

Example 6

In a sixth non-limiting example, a system 10 as shown in FIGS. 19-25 operationally configured for cooling compressed gas in oil and gas related operations is provided including system 10 performance information including (1) the pressure of compressed gas at a fluid inlet 105 of the system 10 ("Pressure In"); (2) the pressure of compressed gas at a fluid outlet 115 of the system 10 ("Pressure Out"); (3) the temperature of compressed gas at the fluid inlet 105 ("Temperature In"); (4) the temperature of compressed gas at the fluid outlet 15 of the system 10 ("Temperature Out"); and (5) the flow rate of compressed gas in MMSCFD as described in Table 6.

TABLE 6

221.0° C./105.0° F. Ambient Temperature of the System 10; 0.85 Specific Gravity

| Pressure In (psi) | Pressure Out (psi) | Temperature In (° F.) | Temperature Out (° F.) | Gas Flow (MMSCFD) |
|---|---|---|---|---|
| 1000.0 | 991.0 | 220.0 | 117.0 | 16.0 |
| 1000.0 | 986.0 | 220.0 | 123.4 | 20.0 |
| 1000.0 | 980.0 | 220.0 | 128.8 | 24.0 |
| 500.0 | 479.4 | 220.0 | 115.6 | 16.0 |
| 500.0 | 468.4 | 220.0 | 120.4 | 20.0 |
| 500.0 | 455.0 | 220.0 | 125.3 | 24.0 |
| 250.0 | 207.2 | 220.0 | 115.0 | 16.0 |
| 250.0 | 184.5 | 220.0 | 119.2 | 20.0 |
| 250.0 | 157.1 | 220.0 | 123.9 | 24.0 |

Example 7

In a seventh non-limiting example, a system 10 as shown in FIGS. 27-34 operationally configured for cooling compressed gas in oil and gas related operations is provided including system 10 performance information as described in Table 7.

TABLE 7

221.0° C./105.0° F. Ambient Temperature of the System 10; 0.85 Specific Gravity

| Pressure In (psi) | Pressure Out (psi) | Temperature In (° F.) | Temperature Out (° F.) | Gas Flow (MMSCFD) |
|---|---|---|---|---|
| 1000.0 | 958.1 | 250.0 | 161.7 | 25.0 |
| 1000.0 | 959.4 | 225.0 | 152.0 | 25.0 |
| 1000.0 | 960.7 | 200.0 | 142.3 | 25.0 |
| 1000.0 | 962.1 | 175.0 | 132.7 | 25.0 |
| 1000.0 | 963.5 | 150.0 | 123.0 | 25.0 |
| 800.0 | 780.6 | 250.0 | 137.7 | 15.0 |
| 800.0 | 780.9 | 225.0 | 132.0 | 15.0 |
| 800.0 | 781.3 | 200.0 | 126.3 | 15.0 |
| 800.0 | 781.6 | 175.0 | 120.7 | 15.0 |
| 800.0 | 782.0 | 150.0 | 115.2 | 15.0 |
| 500.0 | 496.1 | 250.0 | 115.0 | 5.0 |
| 500.0 | 496.1 | 225.0 | 115.0 | 5.0 |
| 500.0 | 496.1 | 200.0 | 115.0 | 5.0 |
| 500.0 | 496.1 | 175.0 | 115.0 | 5.0 |
| 500.0 | 496.1 | 150.0 | 115.0 | 5.0 |

Although the disclosure is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed system and method, whether or not such embodiments are described and whether or not such features are presented as being a part of a described embodiment. Thus, the breadth and scope of the disclosure should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future.

Persons of ordinary skill in the art will recognize that many modifications may be made to the present application without departing from the spirit and scope of the disclosure. The embodiment(s) described herein are meant to be illustrative only and should not be taken as limiting the disclosure, which is defined in the claims.

We claim:

1. A system for cooling fluid flowing through a fluid line, including:

a portable platform supporting thereon a fluid flow path assembly, a power assembly including a power source, and a blower assembly in operable communication with the power assembly;

wherein the fluid flow path assembly includes a first fluid opening, a second fluid opening in fluid communication with the first fluid opening and a third fluid opening in fluid communication with the first fluid opening and the second fluid opening, the first fluid opening and the second fluid opening being operationally configured to fluidly connect to the fluid line;

wherein the first fluid opening and the second fluid opening are interchangeable as a first fluid inlet of the fluid flow path assembly for receiving fluid from the fluid line at a first temperature and as a first fluid outlet of the fluid flow path assembly for conveying the fluid back into the fluid line at a second temperature;

wherein the third fluid opening is operationally configured as a second fluid outlet of the fluid flow path assembly;

wherein the blower assembly is located between the power source and the first fluid opening, the second fluid opening and the third fluid opening of the fluid flow path assembly; and wherein at least part of the fluid flow path assembly is located above the blower assembly.

2. The system of claim 1 wherein the power source includes a natural gas engine located at a first end of the portable platform.

3. The system of claim 1 wherein the first fluid opening, the second fluid opening, and the third fluid opening of the fluid flow path assembly are located at a second end of the portable platform.

4. The system of claim 1 wherein the blower assembly is operationally configured to direct forced air across at least part of the fluid flow path assembly.

5. The system of claim 1 wherein the fluid flow path assembly includes vent members.

6. The system of claim 1 wherein the fluid flow path assembly includes a cooling section including a first header member operationally configured to receive fluid from and convey fluid to the first fluid opening and the second fluid opening.

7. The system of claim 6 wherein the cooling section includes a first tubular member set in fluid communication with a first part of the first header member and a second tubular member set in fluid communication with a second part of the first header member.

8. The system of claim 7 wherein the cooling section includes a second header member operationally configured to receive fluid from and convey fluid to the first tubular member set and the second tubular member set.

9. The system of claim 1 wherein a major part of the fluid flow path assembly is located above the blower assembly.

* * * * *